US009827570B2

(12) United States Patent
Tsai et al.

(10) Patent No.: US 9,827,570 B2
(45) Date of Patent: Nov. 28, 2017

(54) SHREDDER JAM CLEAR APPARATUS

(71) Applicant: AURORA OFFICE EQUIPMENT CO., LTD. SHANGHAI, Shanghai (CN)

(72) Inventors: Chung Shih Tsai, Hawthorne, CA (US); Yung Kang Tso, Shanghai (CN); Xiuming Liu, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 208 days.

(21) Appl. No.: 14/852,406

(22) Filed: Sep. 11, 2015

(65) Prior Publication Data

US 2016/0271618 A1 Sep. 22, 2016

Related U.S. Application Data

(63) Continuation-in-part of application No. 14/663,422, filed on Mar. 19, 2015, now Pat. No. 9,687,854.

(51) Int. Cl.
*B02C 18/00* (2006.01)
*B02C 18/16* (2006.01)

(52) U.S. Cl.
CPC ..... *B02C 18/0007* (2013.01); *B02C 18/16* (2013.01); *B02C 2018/0023* (2013.01); *B02C 2018/0046* (2013.01); *B02C 2018/164* (2013.01)

(58) Field of Classification Search
CPC ..... B02C 18/0007; B02C 18/16; B02C 2018/164; B02C 2018/0046; B02C 2018/0023
See application file for complete search history.

(56) References Cited

U.S. PATENT DOCUMENTS

2006/0054725 A1* 3/2006 Matlin ..... B02C 18/0007 241/37.5

* cited by examiner

*Primary Examiner* — Faye Francis
(74) *Attorney, Agent, or Firm* — WHGC, P.L.C.; John F. O'Rourke

(57) ABSTRACT

A paper shredder having shredder cover and a motor coupled to shredder blades includes a shredder throat in proximity to shredder blades. The shredder throat has a moveable blade, and a fixed blade. A cam coupled to the moveable blade is in communication with a power switch plunger. When the shredder is in the NORMAL/ON position, a throat gap is in its normal position and the cam positions the plunger to power to the motor. When the shredder is in the JAM CLEAR/OFF position, the throat gap is in its wide position and the cam positions the plunger to remove power to the motor. A method is provided, including providing a moveable blade; sensing a throat jammed condition; releasing the moveable blade; moving the moveable blade to a wide gap position; sensing the moveable blade in the wide gap position; turning off the motor in response to the sensing.

12 Claims, 21 Drawing Sheets

SHREDDER JAM CLEAR APPARATUS

CROSS-REFERENCE TO RELATED APPLICATIONS

This application is a continuation-in-part of U.S. Ser. No. 14/663,422, filed Mar. 19, 2015, and entitled Shredder Jam Clear Apparatus, which is co-pending with the present application, which is assigned to the same assignee hereof, and which hereby is incorporated by reference in its entirety.

BACKGROUND

1. Field of the Invention

The present invention relates to paper shredders and, more particularly, to apparatus and methods for clearing jams in paper shredders.

2. Background Art

A shredder inlet has an opening and a throat, formed from at least two throat blades. The inlet receives the material to be shredded and the throat blades direct that material to the shredder blades. The shredder blades convert the material into shreddant, i.e., shredded material. In a typical shredder, the throat blades are fixed, and may be rigid, to prevent fingers and unacceptable items from being pushed into contact with the shredder blades. Some throat blades do not lead to the shredder blades in a straight line, but are disposed at an angle from the opening to further impede the progress of fingers and unacceptable items towards the shredder blades. Typically, a throat has a predetermined opening, that is, the throat blades are spaced apart such that a predetermined mass of material, usually measured in sheets of paper, can successfully be comminuted (shredded). For example, a throat may be about 4 mm wide, to accommodate 6 standard sheets of paper. Exceeding the predetermined mass of material being introduced into a throat can cause a "jam," in which the mass of shredding material being comminuted exceeds the shredder's capability and a wad of partly-shredded material is lodged in the entrance to the shredder blades, causing the shredder motor to momentarily fail. At present, many shredders provide no solution for jams other than to have the user remove the cover of the shredder, which contains the opening and the throat, and expose the jam—and more importantly—the shredder blades. In this case, the user must pull the partially shredded wad from the jaws of the blades, exposing the user to receiving cuts from the blades.

SUMMARY

Described are apparatus and methods for clearing a jam in a paper shredder. In apparatus embodiments, a paper shredder having shredder cover and a motor coupled to shredder blades, includes a shredder throat, coupled to an inlet in the cover and in proximity to the shredder blades. The shredder throat has a moveable throat blade, in which the moveable throat blade widens the shredder throat. The paper shredder embodiments also include an anti-jam switch capable of being activated, and wherein upon activating the motor advances the shredder blades to clear a jam in the widened shredder throat. In some embodiments, the moveable throat blade is moved manually. Also, the anti-jam switch is activated by contact with the moveable throat blade. In some embodiments, the moveable blade is moved with a push-button linkage accessible by the shredder cover, and the moveable blade when widened activates the anti-jam switch.

In other embodiments, the moveable blade is moved with a turn-knob linkage accessible by the shredder cover, and the moveable blade, when widened, activates the anti-jam switch. In still other embodiments, the anti-jam switch is activated by a user contacting a switch button on a shredder cover after moving the moveable throat blade. In yet other embodiments, the moveable blade widens the shredder throat automatically upon a signal. In yet additional embodiments, the anti-jam switch activates automatically upon a signal. In some of these embodiments, the signal is a torque-based measurement from the motor. In others, a force sensor is disposed in the moveable blade capable of sensing a jam in the shredder throat and the signal is a force signal from the moveable blade.

In method embodiments, a method for recovering from a shredder jam in a paper shredder is provided, including providing a moveable throat blade in the shredder throat; sensing a shredder throat jammed condition; releasing the moveable throat blade in the shredder throat; moving the moveable throat blade to a wide gap position; sensing the moveable throat blade in the wide gap position; advancing shredder blades in response to the sensing, wherein the jammed condition is cleared; returning the moveable throat blade to a nominal gap position; and turning off the shredder blades in response to the returning.

In some embodiments, sensing the moveable throat blade in the wide gap position the method includes providing a switch activated by the moveable throat blade in the wide gap position, the switch configured to advance the shredder blades when the switch is activated. In other embodiments, sensing a shredder throat jammed condition includes sensing a predetermined motor torque value. In still other embodiments, sensing a shredder throat jammed condition includes sensing a predetermined force value against the moveable throat blade. In yet other embodiments, releasing the moveable throat blade in the shredder throat comprises manually releasing the moveable throat blade.

In additional embodiments sensing the moveable throat blade in the wide gap position includes providing a switch activated by the moveable throat blade in the wide gap position, in which the switch configured to advance the shredder blades when the switch is activated. In yet further embodiments, sensing the moveable throat blade in the wide gap position includes providing a manually-activated switch configured to advance the shredder blades when the switch is activated. In still other embodiments, sensing the shredder throat jammed condition includes providing a perceptible indication indicative of the shredder throat jammed condition. In some additional embodiments, moving the moveable throat blade to a wide gap position includes manually moving the moveable throat blade to a wide gap position using a push-button linkage. In other additional embodiments, moving the moveable throat blade to a wide gap position includes manually moving the moveable throat blade to a wide gap position using a turn-knob linkage.

In yet other embodiments are provided a paper shredder having an electric motor coupled to shredder blades, including a shredder throat having a fixed throat blade and a moveable throat blade disposed opposite the fixed throat blade, wherein the moveable throat blade provides a wide gap shredder throat and a normal gap shredder throat with respect to the fixed throat blade; a cam coupled to the moveable throat blade; and a power control switch engageable with the cam and having an engaged mode and a disengaged mode. The engaged mode corresponds to a normal gap shredder throat; the disengaged mode corresponds to a wide gap shredder throat. In the engaged mode the cam positions the power control switch to provide electrical power to the electric motor, and in the disengaged mode the cam positions the power control switch to block electrical power to the electric motor. In some embodiments, wherein the moveable throat blade is moved manually. Also, in certain embodiments, an anti-jam switch is activated by contact with the moveable throat blade.

Yet other embodiments provide a paper shredder having an electric motor coupled to shredder blades, including a shredder throat having a fixed throat blade and a moveable throat blade disposed opposite the fixed throat blade, wherein the moveable throat blade provides a wide gap shredder throat and a normal gap shredder throat with respect to the fixed throat blade; a cam attached to the moveable throat blade; and a power control switch is engageable with the cam and has an engaged mode and a disengaged mode. The engaged mode corresponds to a wide gap shredder throat, and the disengaged mode corresponds to a normal gap shredder throat. In the disengaged mode the cam positions the power control switch to provide electrical power to the electric motor, and in the engaged mode the cam positions the power control switch to block electrical power to the electric motor. In some of these embodiments, the moveable throat blade is moved manually. In others of these embodiments, an anti-jam switch is activated by contact with the moveable throat blade.

Further method embodiments for recovering from a shredder jam in a paper shredder having a motor coupled to shredder blades are provided including providing a moveable throat blade in the shredder throat; sensing a shredder throat jammed condition; releasing the moveable throat blade in the shredder throat; moving the moveable throat blade to a wide gap position; turning off the motor in response to the moving; clearing a jam in the shredder throat; returning the moveable throat blade to a nominal gap position; and energizing the motor in response to the returning. In certain of these embodiments, sensing the moveable throat blade in the wide gap position includes providing a switch activated by the moveable throat blade in the wide gap position, the switch configured to advance the shredder blades when the switch is activated. Also embodiments can include sensing a shredder throat jammed condition comprises sensing a predetermined motor torque value. In other embodiments, sensing a shredder throat jammed condition includes sensing a predetermined force value against the moveable throat blade.

In yet other embodiments, sensing the moveable throat blade in the wide gap position includes providing a switch activated by the moveable throat blade in the wide gap position, the switch configured to advance the shredder blades when the switch is activated. In still other embodiments sensing the moveable throat blade in the wide gap position includes providing a manually-activated switch configured to advance the shredder blades when the switch is activated. In still other embodiments, sensing the shredder throat jammed condition includes providing a perceptible indication indicative of the shredder throat jammed condition.

BRIEF DESCRIPTION OF THE DRAWINGS

The invention is generally shown by way of reference to the accompanying drawings in which.

Some embodiments are described in detail with reference to the related drawings. Additional embodiments, features and/or advantages will become apparent from the ensuing description or may be learned by practicing the embodiment. In the figures, which are not drawn to scale, like numerals refer to like features throughout the description. The following description is not to be taken in a limiting sense, but is made merely for the purpose of describing the general principles of the embodiments.

DESCRIPTION

Figure 1:
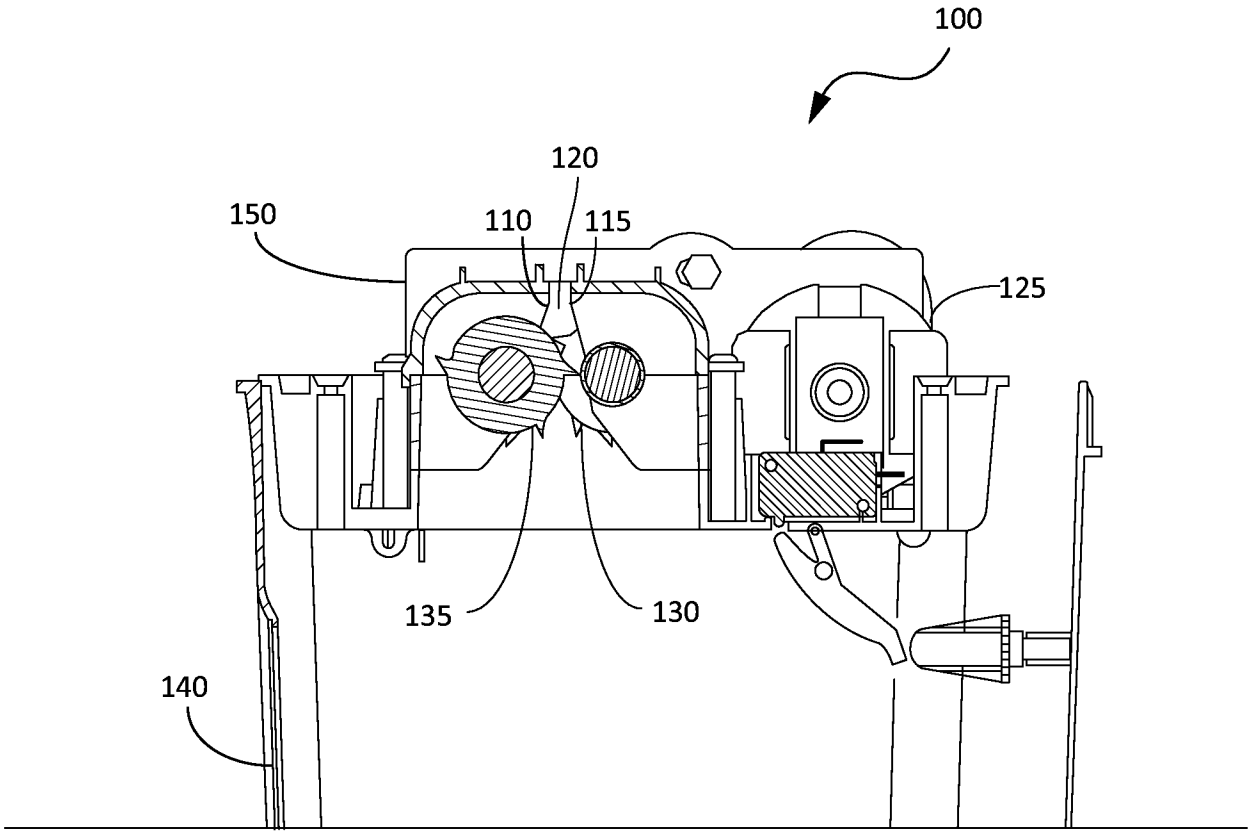
FIG. 1 is a side view illustration of a shredder, in accordance with the teachings herein.

Embodiments provide mechanisms to do away with paper shredder throat jams. In FIG. 1, exemplary conventional shredder 100 is shown having throat blades 110, 115 forming shredder throat 120. Material to be shredded (not shown) can be introduced into throat 120, and motor 125 can be activated. Motor 125 ultimately drives shredder blades 130, 135. If the amount of material introduced into throat 120 is not excessive, the shredding material will be comminuted into shreddant. If the amount of material is excessive, a jam can occur from a wad of shredding material in throat 120. In FIG. 1, throat blades 110, 115 can be fixed, rigid metal or plastic blades. At least a portion of one or both throat blades 110, 115 can be moveable. For example, at least a part of throat blade 115 can be moveable. When an excessive amount of material is introduced into shredder 100, throat 120 can become clogged and causing shredder blades 130, 135 to jam. Typically, a jam requires between about 10 lbs. to about 15 lbs. of force to clear the jam. In accordance with the embodiments herein, a jam may require as little as 1 lb. of force to clear the jam. In the embodiments herein, a shredder jam clear apparatus can be disposed in shredder upper cover 150. The shredder jam clear apparatus can make throat 120 wider when necessary (e.g., during a jam) but otherwise keep throat 120 in its narrower, nominal operating condition for safety.

In embodiments of shredder jam clear apparatus 200, as illustrated in FIG. 2 through FIG. 5, shredder inlet 205 is formed from at least two throat blades 210, 215 with one blade 215 being at least partly moveable to permit clearing of jams which may occur in the throat 220. Apparatus 200 can be provided with a jam indicator light 230 shown in FIG. 2, which, when illuminated, can indicate the presence of a jam. Such a presence can be sensed, for example, by a shredder torque measuring device on the shredder motor (not shown). Other perceptible indications of the presence of a jam may be provided, for example, without limitation, a flashing light, a beeper, a buzzer, or some other aural, visual, or external signal. A shredder having torque-based measurements is described in U.S. Pat. No. 8,967,509 (Ser. No. 13/506,586), filed Apr. 30, 2012, and assigned to the same assignee hereof, and which is incorporated herein by reference in its entirety. A decrease in motor operating speed, below a predetermined level, may be sensed by a torque sensor as being indicative of excessive torque representing motor overloading. Thus, a torque sensor may be used to indicate shredder jams.

Figure 2:
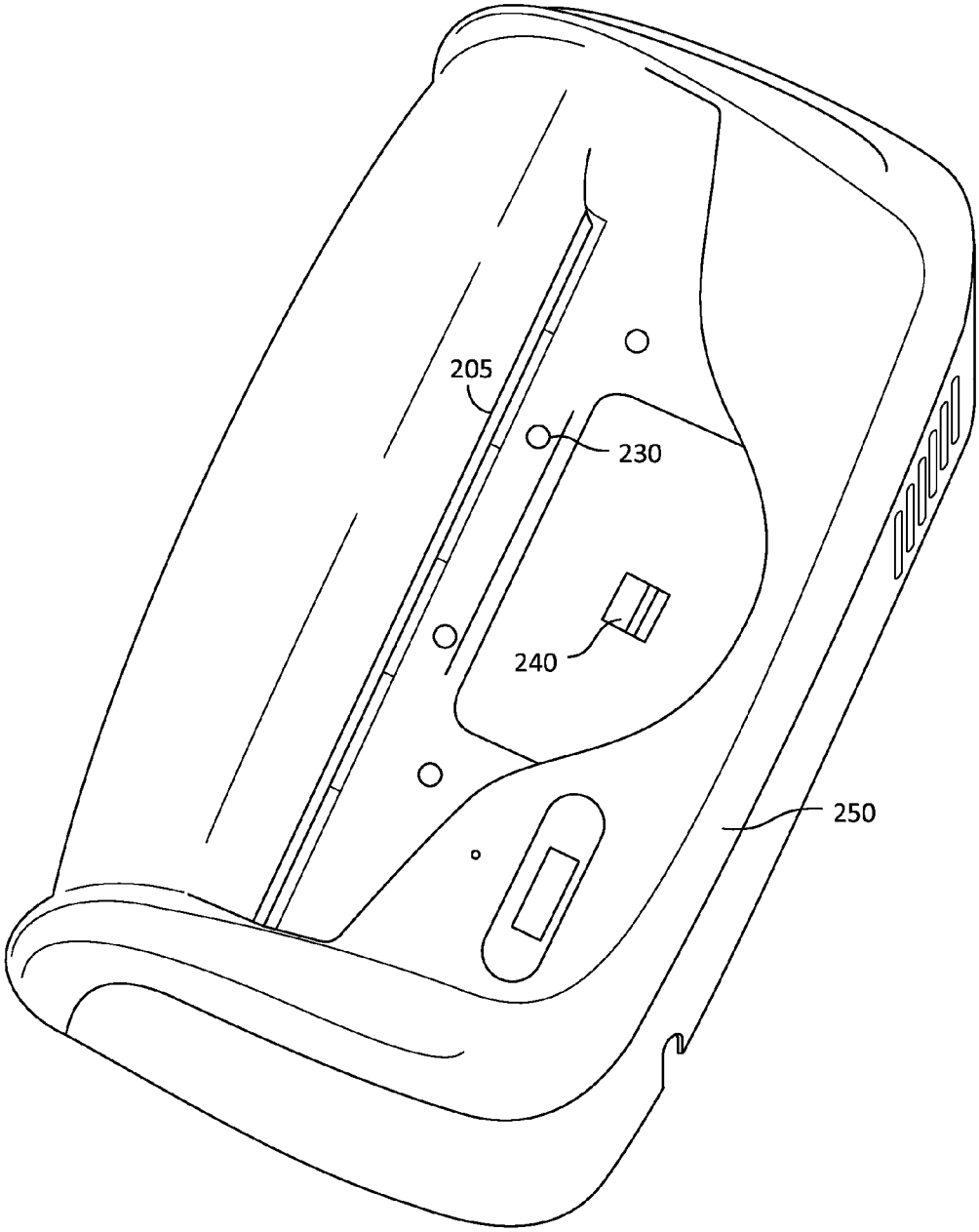
FIG. 2 is a view of an obverse side of a shredder cover of a first embodiment, in accordance with the teachings herein.
Figure 3:
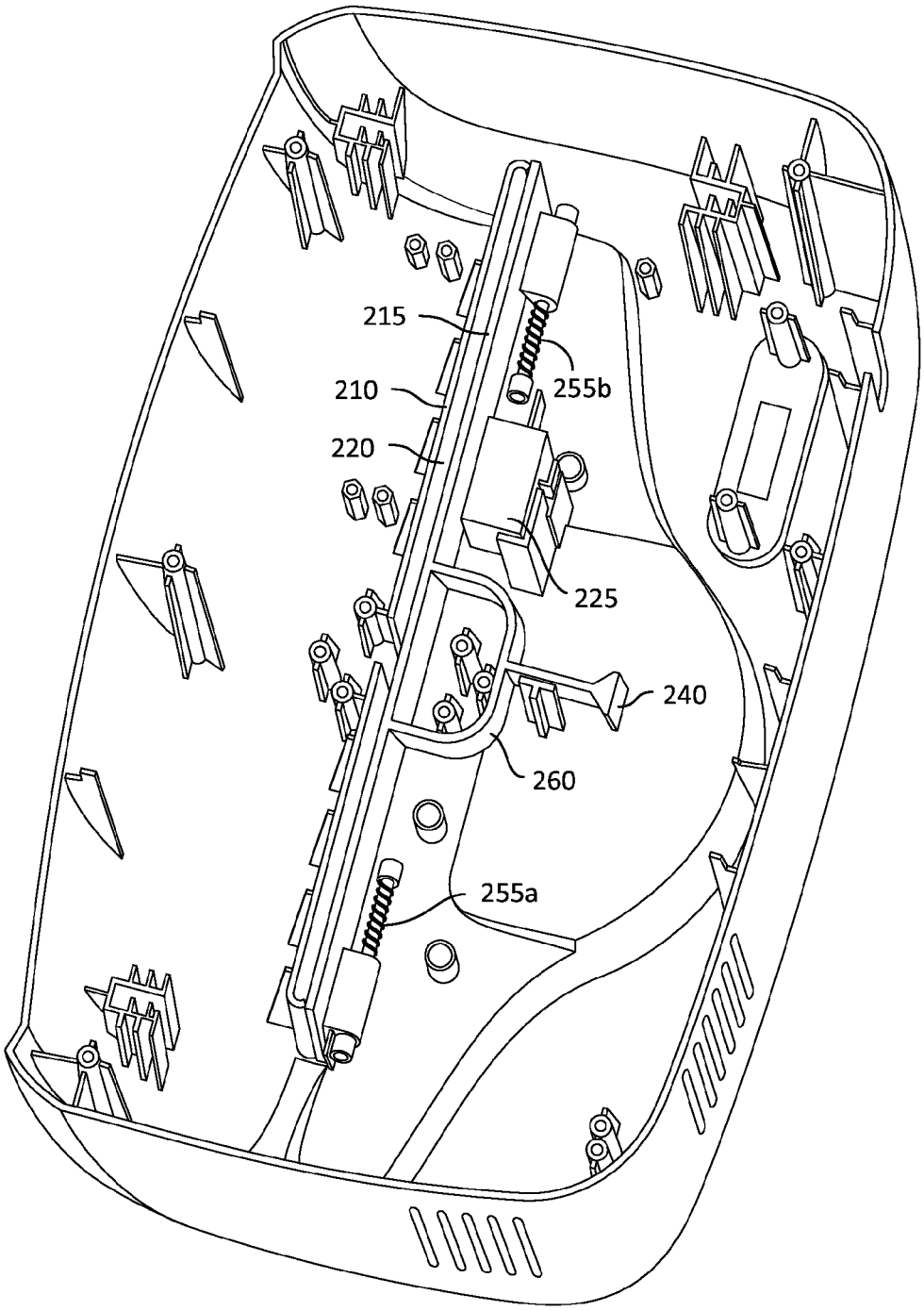
FIG. 3 is a view of the reverse side of the shredder cover in FIG. 2, with a push-button linkage, in accordance with the teachings herein.
Figure 4:
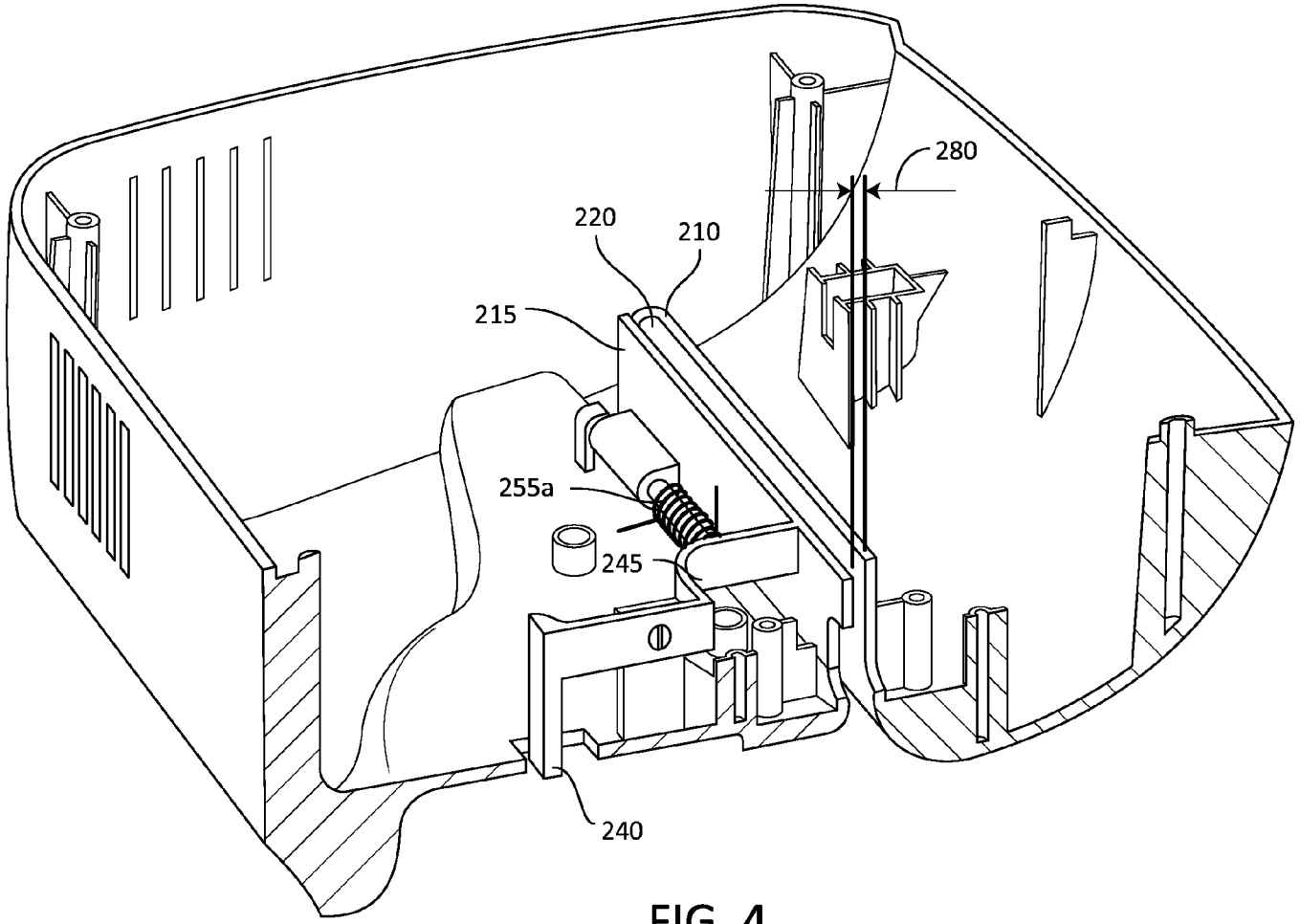
FIG. 4 is a cut-away view of the shredder cover of FIG. 3 in a nominal gap position, in accordance with the teachings herein.
Figure 5:
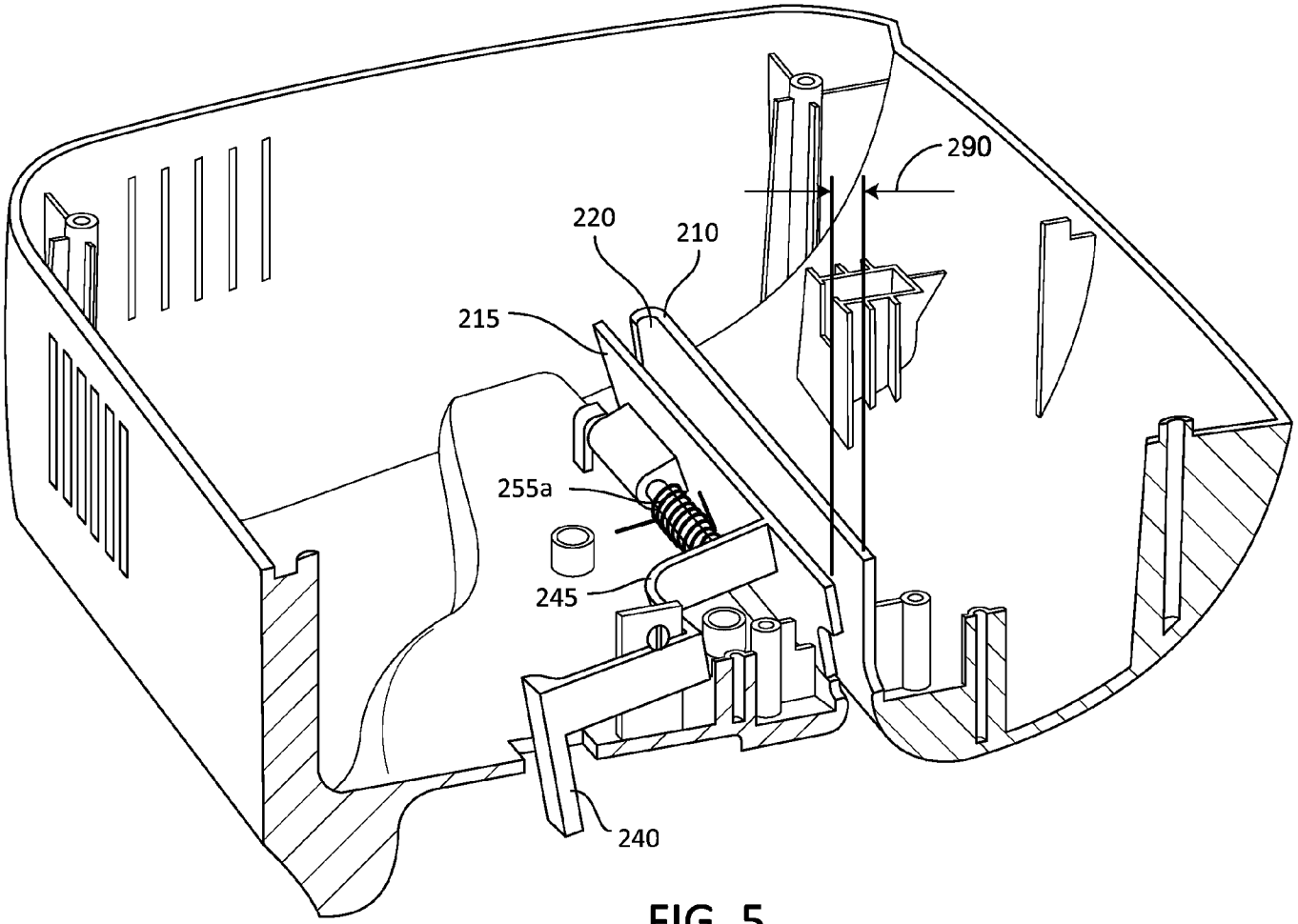
FIG. 5 is a cut-away view of the shredder cover of FIG. 3 in a wide gap position, in accordance with the teachings herein.

As seen in FIGS. 3-5, some embodiments provide jam clearing by moving at least a portion of throat blade 215, such that the confinement of the partially-shredded wad (not shown) in throat 220 can be released. In addition to the at least partly moveable blade 215, the shredder motor may be automatically activated by contact switch 225 when the throat blade 215, moves throat blade 215 from its nominal gap 280 to its wide gap 290. This allows the shredder blades (not shown) to comminute the wad without the user's hands coming into contact with the shredder blade, or without removing the cover of the shredder. To activate the feature, the user need only depress button 240 on the obverse exterior of the cover, as is illustrated in FIG. 2. Returning to FIGS. 3-5, the accompanying push-button linkage drives open throat blade 215 until it engages contact switch 225. Engaging switch 225 activates the anti-jam feature. The initial (nominal) throat gap 280 may be about 4 mm, as is illustrated in FIG. 4. Depressing button 240 causes the D-shaped force-spreader 245 to pull back moveable throat blade 215 and be repositioned open relative to fixed throat blade 210. The repositioned (wide) throat gap 290 may be about 7 mm or more, as illustrated in FIG. 5. The repositioned throat blade 215 can activate jam-clearing switch 275, which causes the shredder blades (not shown) to engage, to move forward in the normal cutting motion, and to digest the now-freed jam. For example, a 4 mm throat can be opened to 7 mm, with the wider throat allowing for release of the wad from the throat and comminution of the jammed material. This jam-clearing occurs with shredder cover 250 in-place, so that the user's hands are not exposed to the shredder blades (not shown). D-shaped force-spreader 260 can be biased closed by springs 255*a, b* until released by button 240 and then repositioned when the button is no longer depressed.

Alternately, button 240 may be disposed to move upwards when first depressed allowing D-shaped force spreader 260 to move backwards away from fixed throat blade 210, being biased open by springs 255*a, b*. In turn, moveable throat blade 215 is pulled back away from blade 210 causing throat gap 290 to be widened relative to its nominal position, for example, 7 mm instead of 4 mm. By depressing switch 240 again, D-shaped force spreader 260 advances toward fixed throat blade 210 and latches in position when full travel of button 240 is realized.

Figure 6:
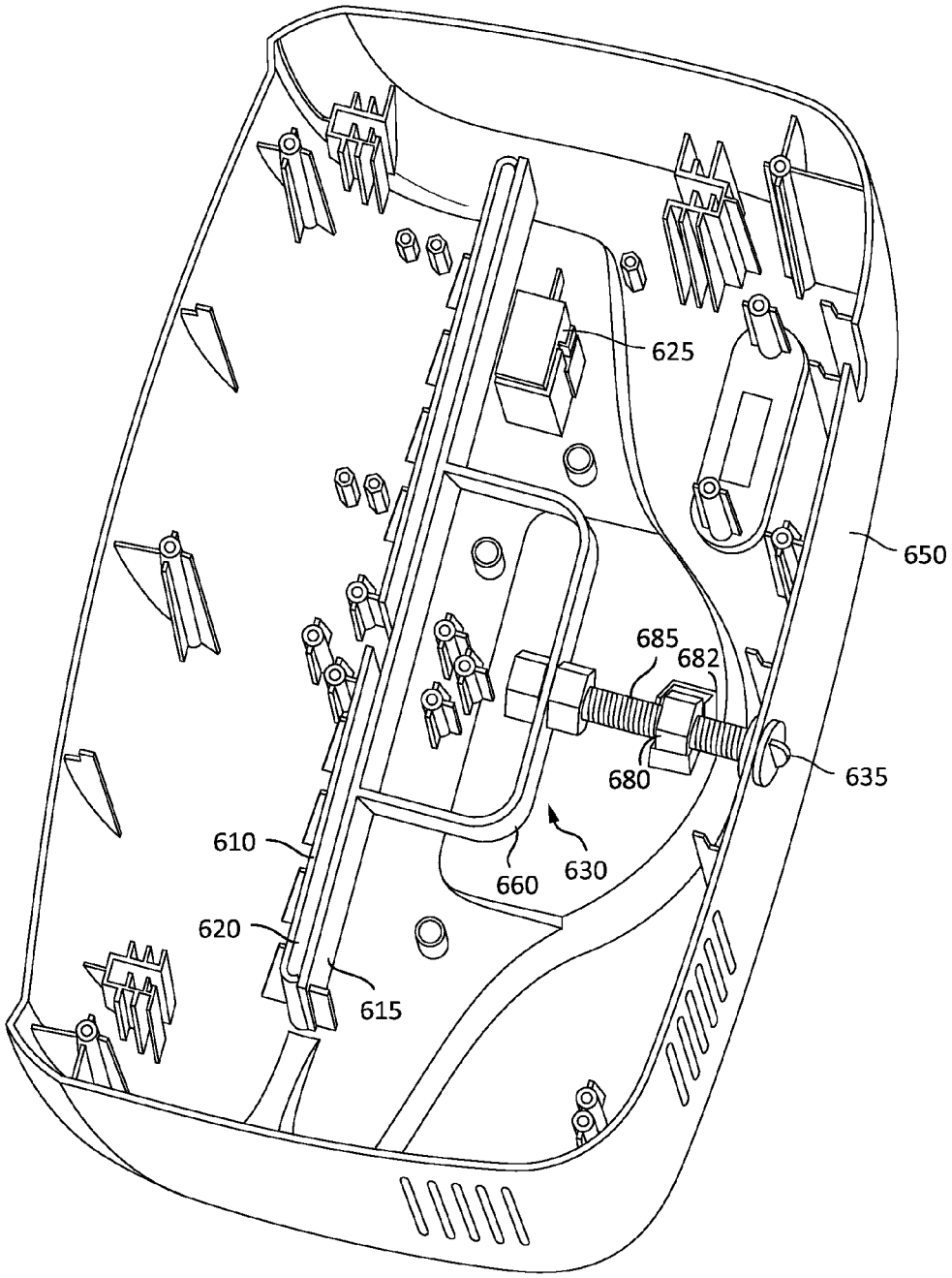
FIG. 6 is a view of an obverse side of a shredder cover of another embodiment, with a turn-knob linkage.
Figure 7:
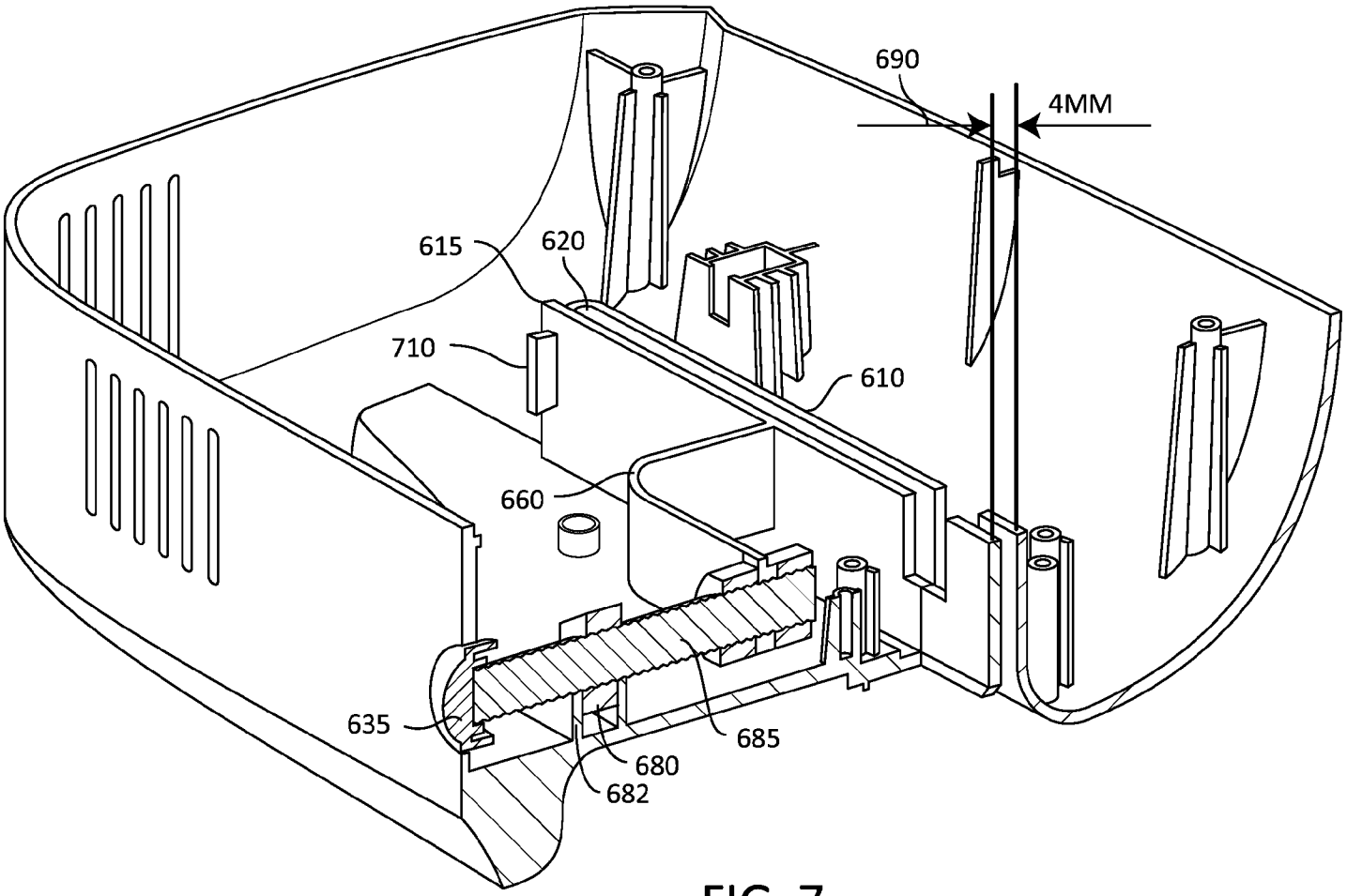
FIG. 7 is a cut-away view of the shredder cover of FIG. 6 in a nominal gap position.
Figure 8:
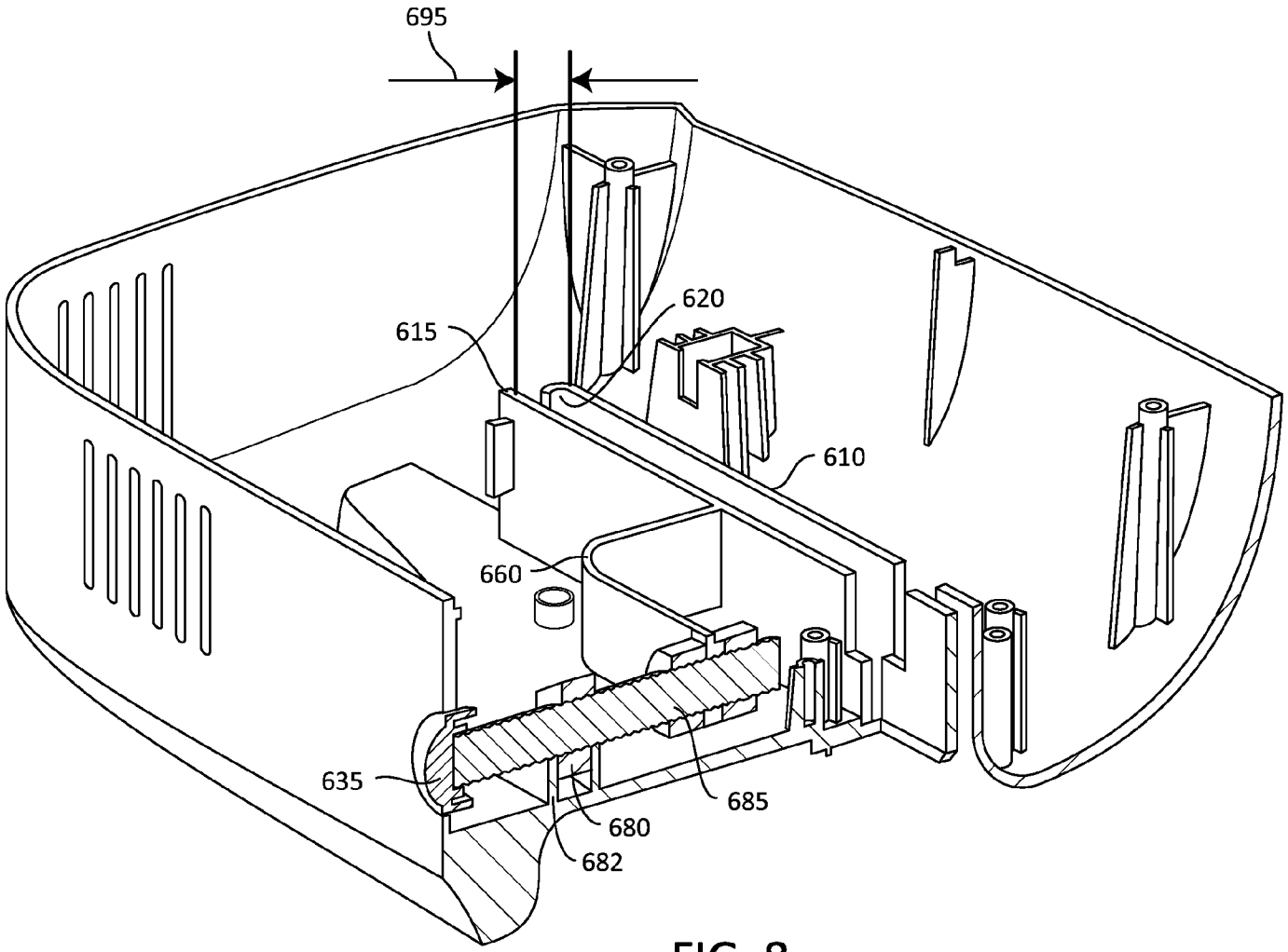
FIG. 8 is a cut-away view of the shredder cover of FIG. 6 in a wide gap position.
Figure 9:
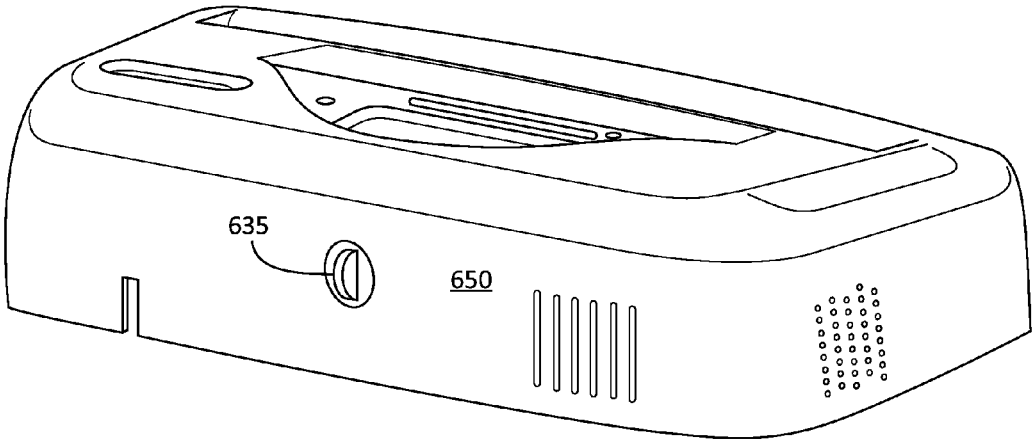
FIG. 9 is a perspective view of the obverse side of the shredder cover in FIG. 6, with the turn-knob linkage.

In other embodiments, shown in FIGS. 6 through 9, shredder jam clear apparatus 600 is described. In FIG. 6, shredder throat 620 can be formed from at least two throat blades 610, 615. One throat blade 615 can be released by a turn-knob 635, which turn-knob 635 may be situated at the rear of cover 650. Turn knob 635 can be provided with linkage 630, which may include a D-shaped force spreader 660 pressing upon the releasable throat blade 615. Linkage driveshaft 685 can be coupled to turn-knob 635 on one end and force spreader 660 on the other end. As illustrated in FIG. 7, positioning apparatus 680, which may be a captured nut, can guide driveshaft 685 to move forwards or backwards, thus translating rotating motion into linear motion. Apparatus 680 may include a nut capturing device 682. FIG. 8 illustrates that as turn-knob 635 is rotated, for example, by one-quarter turn counterclockwise, the D-shaped force spreader 660 and attached releasable throat blade 615 can be backed away from the fixed throat blade 610, opening throat 620 wider, relative to a normal operating gap 690 of about 4 mm. A jam-clearing gap 695 can be, for example, 7 mm. FIG. 9 depicts placement of turn-knob 635 on the obverse-rear side of cover 650.

When releasable throat blade 615 reaches the maximum opening point, it can activate the jam-clearing switch 625, which causes the shredder blades to engage and operate in the forward direction, digesting the wad. For example, a 4 mm throat can be opened to 7 mm, with the wider throat 620 allowing for release of the wad from the throat 620 and comminution of the jammed material. An opening wider than 7 mm also can be provided to clear throat 620. When the wad is cleared, turn-knob 635 can be turned in the reverse direction, causing the releasable throat blade 615 to return to its normal operation gap 690 relative to fixed blade 610 and causing jam-clearing switch 625 to be de-activated.

Figure 10:
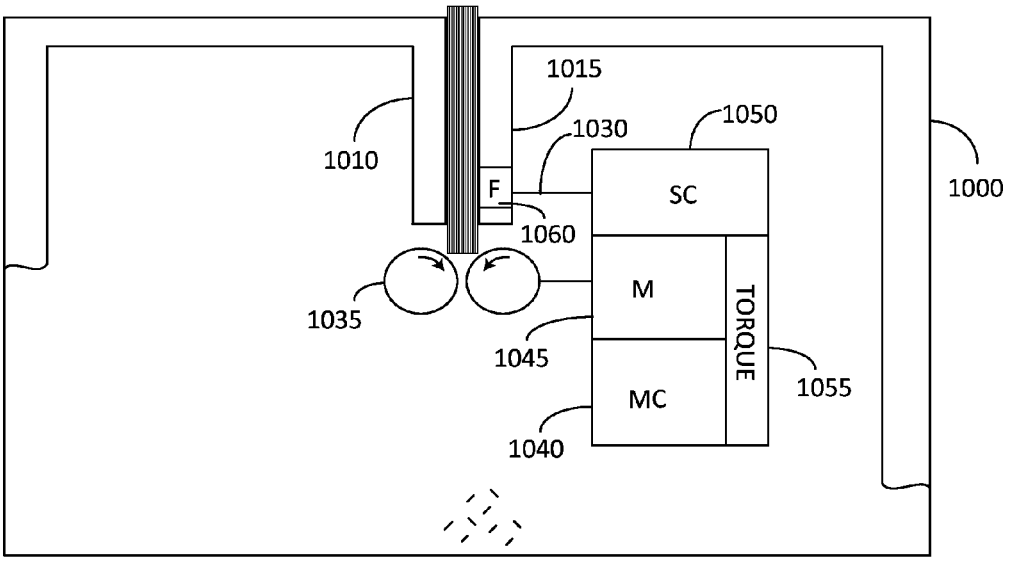
FIG. 10 is a side-view cut-away illustration of some shredder embodiments, having a moveable throat in a nominal gap position.
Figure 11:
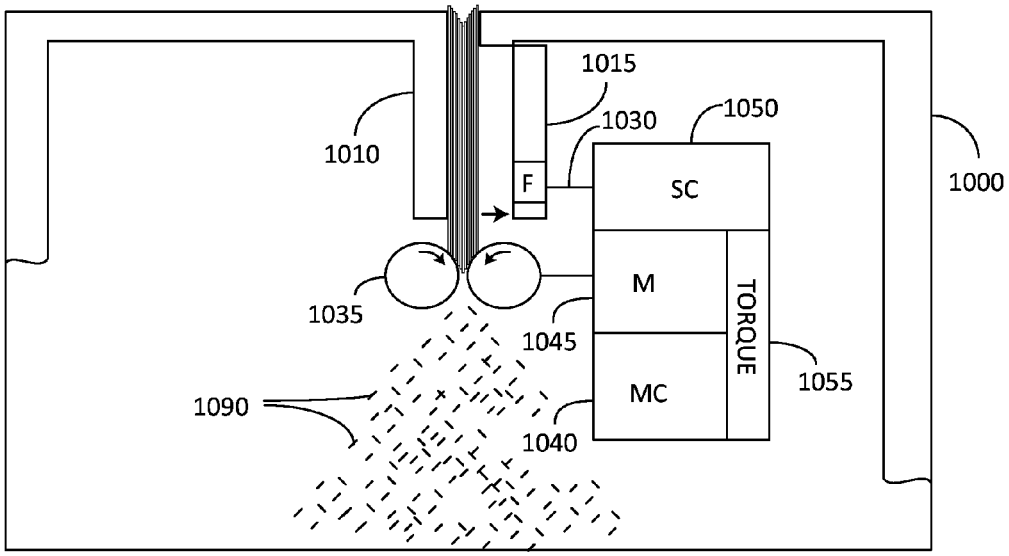
FIG. 11 is a side-view cut-away illustration of FIG. 10, having a moveable throat in a wide gap position.

In yet other embodiments, the shredder jam clear mechanism can be automated. In FIGS. 10 and 11, the paper shredder 1000 may include fixed throat blade 1010, moveable throat blade 1015, throat 1020, actuator arm 1030 coupled to moveable throat blade 1015, shredder blades 1035 coupled to motor controller 1040, and motor 1045, shredder controller 1050, torque sensor 1055 coupled to motor controller 1040, motor 1045, and shredder controller 1050, shredding material 1075, and shreddant 1090. For example, without limitation, the jam may be sensed by torque sensor 1055 in motor 1045; actuator arm 1030 may be actuated by a solenoid in shredder controller 1050. An increase in motor torque beyond a predetermined torque limit can indicate a paper jam in throat 1020. In FIG. 10, a larger-than-nominal amount of shredding material 1075 can be introduced into throat 1020. This causes the paper shredder blades to slow down and strain. The increased torque generated by the overload condition is sensed by torque sensor 1055. Alternatively, a strain gauge or force sensor 1060 may be mounted on or in a flexible moveable throat blade 1015, or in fixed blade 1010, and sensed by shredder controller 1050. As shown in FIG. 11, whether increased torque, or increased strain or force, is detected, a motor overload condition can be sensed, causing actuator arm 1030 to retract, for example, using a solenoid. Retraction of actuator arm 1030 can pull back moveable throat blade 1015, and shredder controller 1050 causes motor 1045 to advance shredder blades 1035. The wide throat gap (e.g., about 7 mm) created by retracting moveable throat blade 1015 can ameliorate the overload condition such that the shredding material 1075 can be successfully comminuted into shreddant 1090. Once the overload condition has passed, and normal shredding operation is sensed, for example, by the motor torque sensor 1055, or force sensor 1060, shredder controller 1050 can cause actuator arm 1030 to return moveable throat blade 1020 to normal operating conditions and normal throat gap (e.g., about 4 mm). The shredder may turn off, in waiting for a new load of shredding material.

Figure 12:
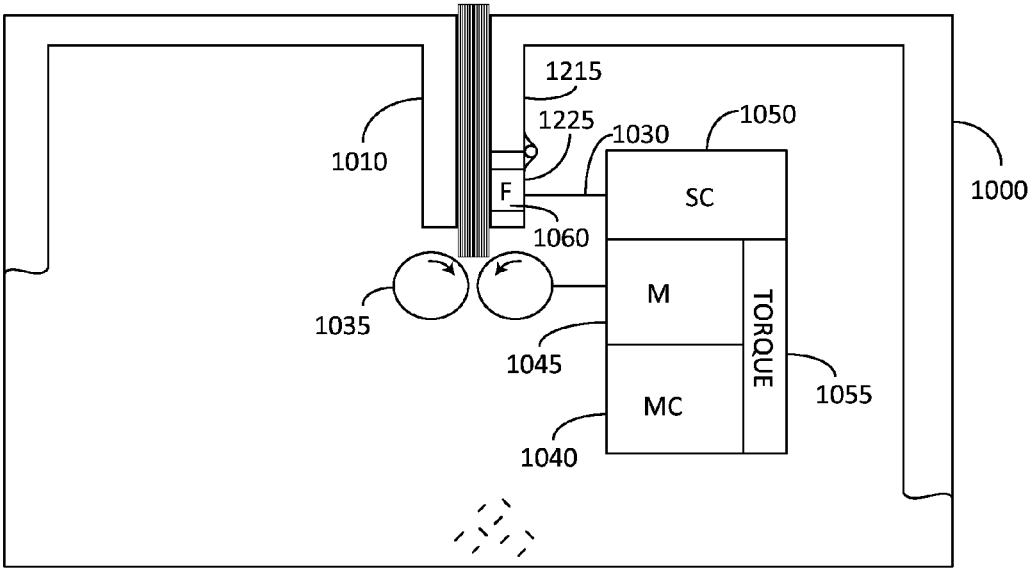
FIG. 12 is a side-view cut-away illustration of other shredder embodiments, having a moveable throat with a release bar in a nominal gap position.
Figure 13:
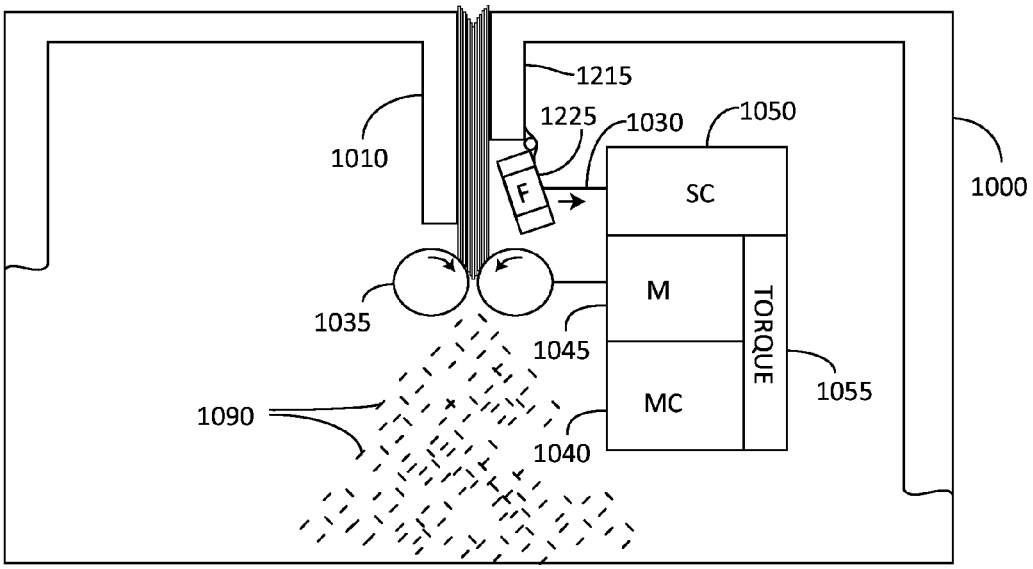
FIG. 13 is a side-view cut-away illustration of FIG. 12, having a moveable throat with a release bar in a wide gap position.

In FIGS. 12 and 13, at least a portion of throat inlet blade 1215 can be coupled to a release bar 1225. FIG. 12 can be similar to FIG. 10. Release bar 1225 can be formed from a hinged, spring-loaded throat flap portion, which can be held in place by actuator arm 1030. A torque sensor 1055 may be used to detect an overload or jam event. Alternatively, a strain gauge or force sensor 1060 may be mounted on or in a flexible moveable throat blade 1015, and sensed by shredder controller 1050.

As illustrated in FIG. 13, when an overload is sensed, for example without limitation, by torque sensor 1055, or by force sensor 1060, shredder controller 1050 can cause actuator arm 1030 to release spring-loaded release bar 1225. Shredder controller 1050 can activate anti-jam features by causing shredder blades 1035 to move forward. The additional space given to the shredding material 1075 allows shredder blades 1035 to comminute shredding material 1075 into shreddant 1090.

In yet other embodiments, release bar 1225 may be released by a push button mechanism, similar to that described with respect to FIGS. 2-5. In still other embodiments, release bar 1225 may be released by a turn-knob mechanism as described with respect to FIGS. 6-9. In either embodiment, the opening of the release bar could activate jam-clearing switch, such as switch 225, which causes the shredder blades 1035 to engage and operate in the forward direction, digesting the jamming wad. Alternatively to anti-jam switch 225, an electro-optic device may be used.

Figure 14:
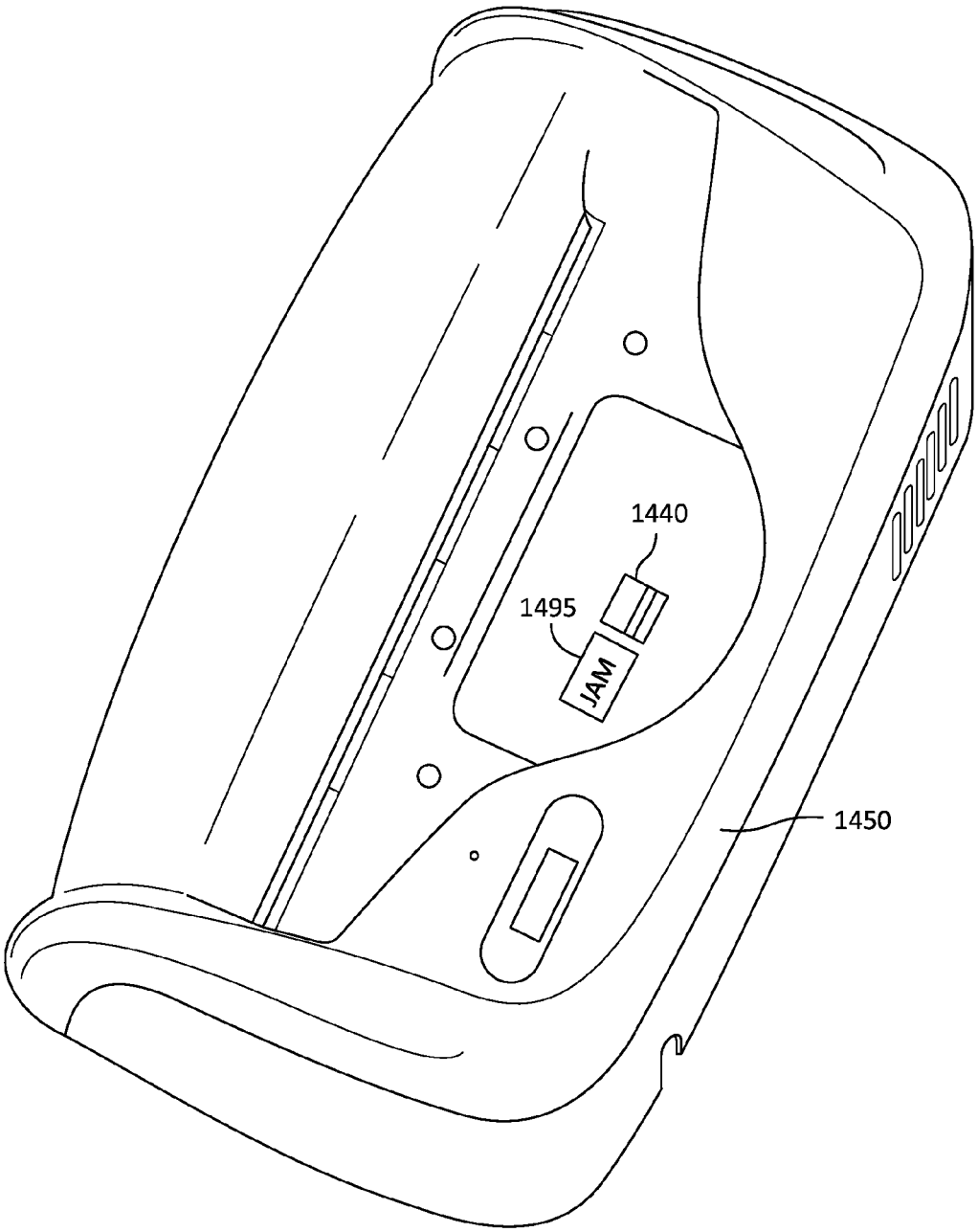
FIG. 14 is a top illustration of an obverse side of another embodiment, having push-button linkage and manual push-button anti-jam activation.

In yet additional embodiments, the jam-clearing switch can be manually activated. For example, in FIG. 14, similar to the description regarding FIG. 2, by pressing a first button 1440 on cover exterior 1450, the moveable throat blade (not shown) can be released into its wide gap setting. Then, pressing a second button 1495, the anti-jam feature can be activated such that the shredder blades (not shown) move forward and the jamming wad of shredding materials is comminuted into shreddant, clearing the shredder jam.

Figure 15:
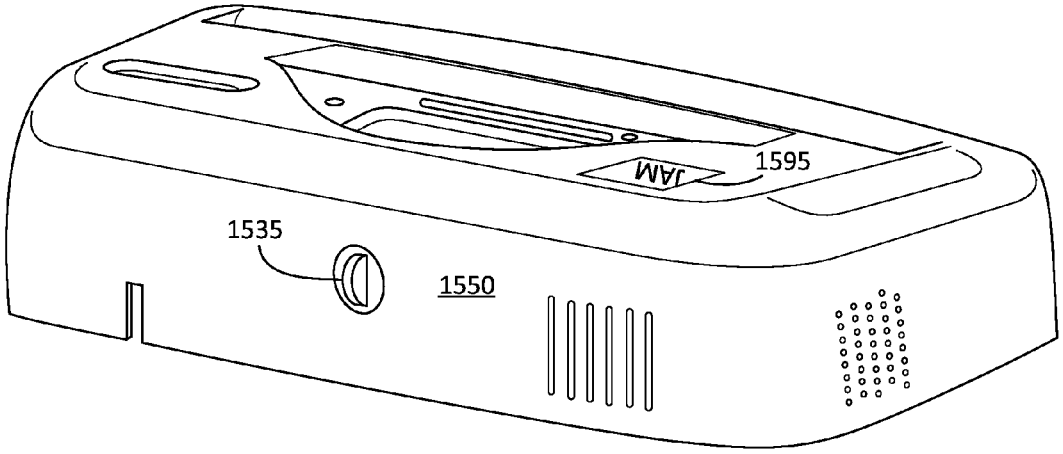
FIG. 15 is a perspective illustration of an obverse side of yet another embodiment, having turn-knob linkage and manual push-button anti-jam activation.
Figure 16:
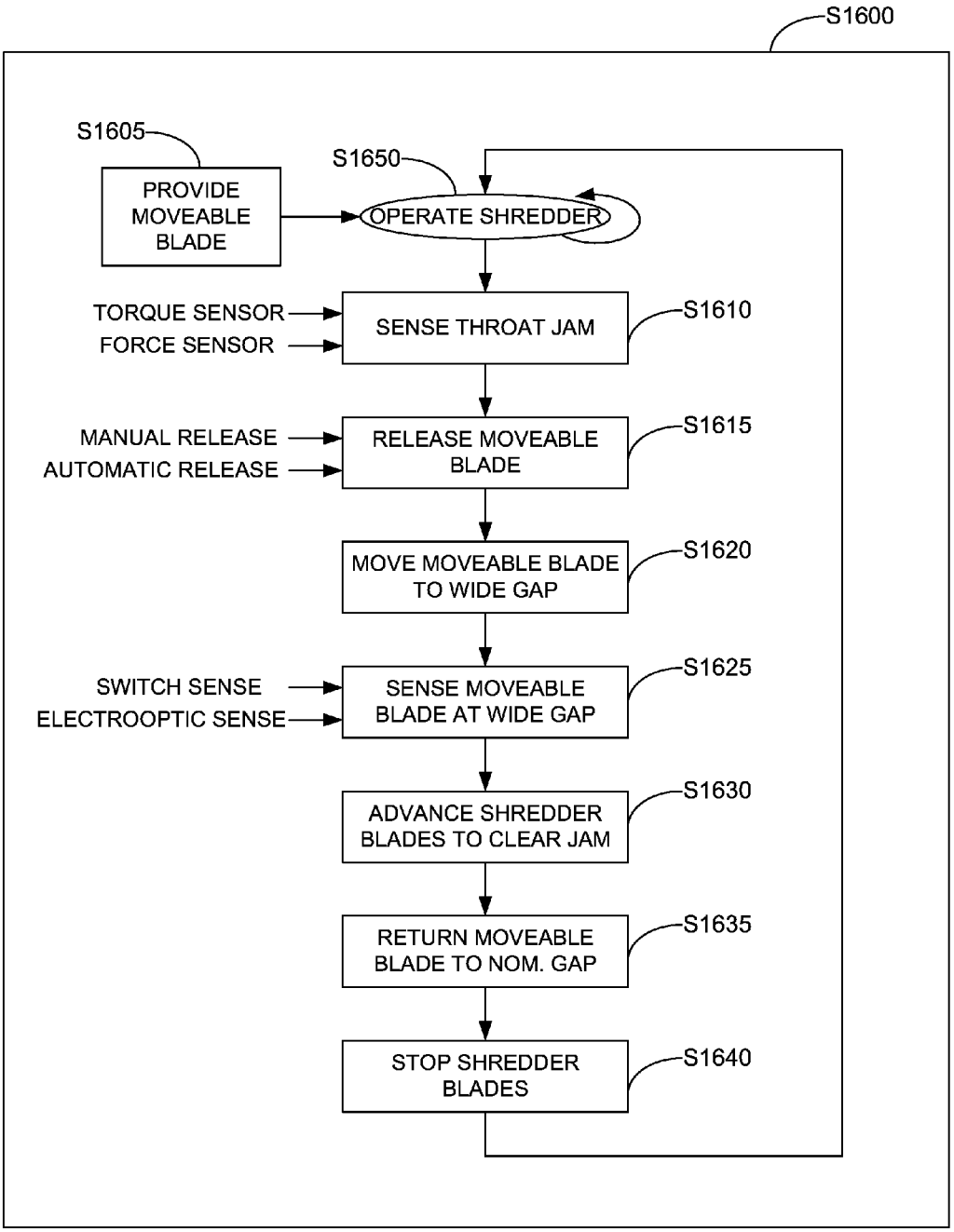
FIG. 16 is a block diagram of exemplary methods.

Similar to the description relative to FIG. 9, in FIG. 15, turn-knob 1535 may be disposed on the exterior cover 1550 of the shredder. By turning knob 1535, the moveable throat (not shown) may be released into its wide gap setting. Then, pressing a second button 1595, the anti-jam feature can be activated such that the shredder blades (not shown) move forward and the jamming wad of shredding materials is comminuted into shreddant, clearing the shredder jam. In FIG. 16, a method 1600 for recovering from a shredder jam in a paper shredder is provided. The paper shredder is provided (S1605) with a moveable throat blade in the paper shredder inlet throat, as is described above. Method 1600 proceeds from, while operating the paper shredder sensing (S1610) a shredder throat jammed condition, for example, using a shredder motor torque sensor or a throat blade force sensor, releasing (S1615) the moveable throat blade in the shredder throat, for example, using a press-button manual linkage, a turn-knob linkage, or an automated actuator arm, and moving (S1620) the moveable throat blade to a wide gap position, which relieves the confined shredding material jammed in the shredder inlet throat. Sensing (S1625) the moveable throat blade in the wide gap position can be a switch which, when actuated, advances (S1630) the paper shredder blades in order to clear the jam. Advancing S1630 can be by manual switch or it can be automated. Sensing S1625 also may be performed by an electro-optic sensor. Once the jam has been digested or removed, the moveable throat blade can be returned (S1635) to its nominal gap position. With the jam digested and the moveable throat blade returned to its nominal gap position, the shredder blades can be turned off (S1640) in preparation for normal jam-free operations (S1650).

Figure 17A:
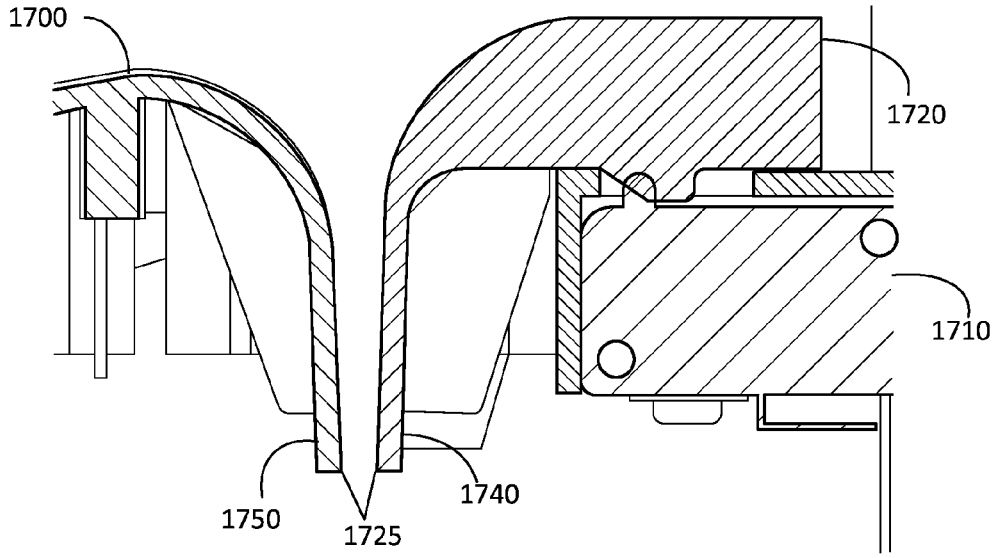
FIG. 17A is a side cross-section illustration of one shredder embodiment with a rounded shredder paper cover in a nominal gap position.

In still other embodiments, the jam-clearing apparatus can be manually activated. However, other features of the above embodiments may be employed. FIG. 17A is a side-view illustration of one embodiment of upper shredder cover 1700, including power switch 1710, shredder paper cover 1720, and upper shredder cover 1700. Shredder paper cover 1720 is moveable, and can provide a moveable throat blade 1740. Upper shredder cover 1700 is fixed and can incorporate a fixed throat blade 1750. Together, blades 1740 and 1750 can define at least a portion of moveable shredder inlet throat 1725. In embodiments, for example in which the paper shredder paper cover 1720 is shown in the NORMAL/ON position, upper shredder cover 1700 fixed throat 1750 is set apart from shredder paper cover 1720 moveable throat 1740 by a predetermined distance providing moveable shredder inlet throat 1725 of a nominal gap width. The nominal gap width of the inlet throat opening in the NORMAL/ON position can be about 3 mm, although the size depends upon the number of sheets of paper that the shredder is capable of shredding. i.e., the paper shredder sheet rating.

Power switch 1710, which may be a micro-switch, can be disposed in upper shredder cover 1700. Actuation plunger 1775 can be in communication with cam 1780 disposed on shredder paper cover 1720. When in the NORMAL/ON (standby) position as is shown in FIG. 17, a nominal throat gap can be present, and shredder paper cover 1720 is positioned such that cam 1780 contacts actuation plunger 1775, causing the shredder motor (not shown) and operational electronics (not shown) to be energized. When an appropriate amount of shreddable material is introduced into moveable shredder inlet throat 1725, shredding is begun and continues until substantially all of the shreddable material has been comminuted. An "appropriate amount of shreddable material" can be anywhere from one partial sheet of paper up to a preselected number of sheets of shreddable material of a given thickness (generally, the shredder "rating").

Figure 17B:
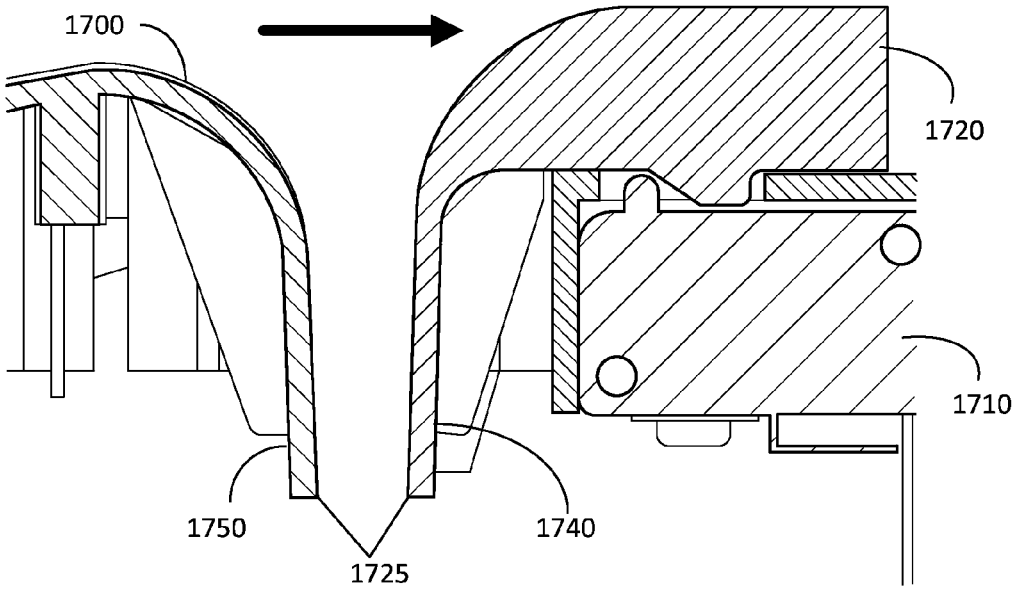
FIG. 17B is a side cross-section illustration of one shredder embodiment with a rounded shredder paper cover in wide gap position.

FIG. 17B is a side-view illustration of one embodiment of upper shredder cover 1700 as in FIG. 17A, including power switch 1710, shredder paper cover 1720 and upper shredder cover 1730, this time in the JAM CLEAR/OFF position, in which the throat is in the wide gap position. As is illustrated in FIG. 17B, when excessive shreddable material is introduced into moveable shredder inlet throat 1725, a wad of material (not shown for clarity) may form such that throat 1725 is blocked and the shredder blades are obstructed. This condition is known as a "jam," and is both unsatisfactory to the user as well as harmful to the jammed shredder motor. In embodiments herein, shredder paper cover 1720, i.e. moveable throat blade 1740, is designed to be pushed away from the front cover of upper shredder cover 1700, i.e. fixed throat blade 1740, such that moveable shredder inlet throat 1725 opens to provide a wide gap. When moveable shredder paper cover 1720 is operated to open throat 1725, cam 1780 can be moved clear of power switch 1710 actuation plunger 1775. When actuation plunger 1775 is no longer in contact with cam 1780, switch 1710 is positioned to de-energize the shredder motor, powered blades, and operational electronics, for the user safety. In general, for a shredder with a rating corresponding to about 3 mm gap width for moveable shredder inlet throat 1725, moveable throat blade 1740 can be made to move an additional 4 mm for a 7 mm total throat gap width. Of course, nominal moveable shredder inlet throat gap width of 3 mm, moveable shredder inlet throat expansion width of 4 mm and total moveable shredder inlet throat gap width of 7 mm are examples only. Indeed, shredders may be rated for a predefined nominal throat gap width, a predefined throat expansion width, and a predefined total throat gap width, according to the rating of shreddable material for a given model. With the wider moveable throat, the user may clear the throat jam readily, and quickly return the shredder to service by sliding shredder paper cover 1720 to the NORMAL/ON (standby) position.

Figure 18A:
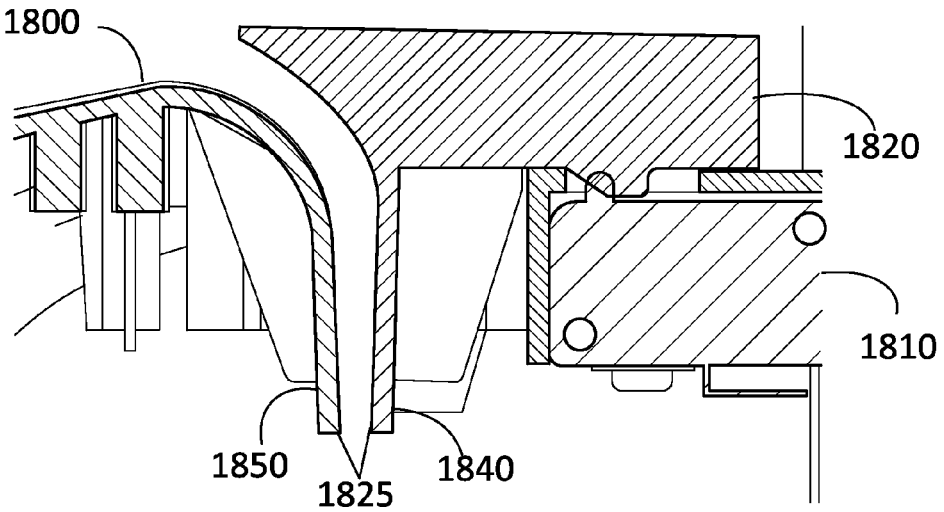
FIG. 18A is a side cross-section illustration of one shredder embodiment with an angled shredder paper cover in a nominal gap position.
Figure 18B:
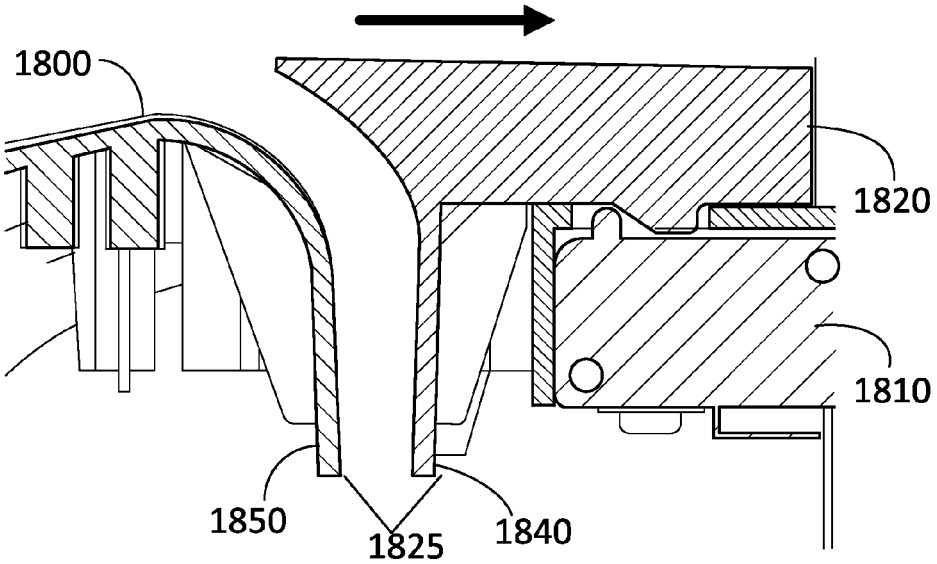
FIG. 18B is a side cross-section illustration of one shredder embodiment with an angled shredder paper cover in a wide gap position.

FIGS. 18A and 18B are another embodiment of an assembly similar to that illustrated in FIGS. 17A and 17B. However, for at least a portion of the moveable shredder inlet throat 1825, shredder paper cover 1820 is angled causing a bend in moveable shredder inlet throat 1825. FIG. 18A is a side-view illustration of one embodiment of upper shredder cover 1800, including power switch 1810, angled shredder paper cover 1820 and upper shredder cover 1800. As in FIG. 17, shredder paper cover 1820 is moveable, and can provide a moveable throat blade 1840. Upper shredder cover 1800 also can incorporate a fixed throat blade 1850. Together, blades 1840 and 1850 can define at least a portion of moveable shredder inlet throat 1825 with a selectable gap. In embodiments, for example, in which the paper shredder paper cover 1820 is shown in the NORMAL/ON position, upper shredder cover 1800 fixed throat 1850 is set apart from shredder paper cover 1820 moveable throat 1840 by a predetermined distance, allowing providing moveable shredder inlet throat 1825 with a nominal gap width. The nominal gap width of the inlet throat opening in the normal operating NORMAL/ON position can be about 3 mm, although the size depends upon the number of sheets of paper that the shredder is capable of shredding. i.e., the paper shredder sheet rating.

Power switch 1810, which may be a Micro-switch, is disposed in upper shredder cover 1800, but actuation plunger 1875 is in communication with cam 1880 disposed on shredder paper cover 1820. When in the NORMAL/ON (standby) position as is shown in FIG. 18A, angled moveable shredder paper cover 1820 is positioned such that cam 1880 contacts actuation plunger 1875, causing the shredder motor (not shown) and operational electronics (not shown) to be energized. When an appropriate amount of shreddable material is introduced into moveable shredder inlet throat 1825, shredding is begun and continues until substantially all of the shreddable material has been comminuted. An "appropriate amount of shreddable material" can be anywhere from one partial sheet of paper up to a preselected number of sheets of shreddable material of a given thickness (generally, the shredder "rating" or "rated amount").

FIG. 18B is a side-view illustration of one embodiment of upper shredder cover 1800 as in FIG. 18A, including power switch 1810, angled moveable shredder paper cover 1820 and upper shredder cover 1830, this time in the JAM CLEAR/OFF position. As is illustrated in FIG. 18B, when excessive shreddable material is introduced into moveable shredder inlet throat 1825, a wad of material (not shown for clarity) may form such that throat 1825 is blocked and the shredder blades are obstructed. This condition is known as a "jam," and is both unsatisfactory to the user as well as harmful to the jammed shredder motor. In embodiments herein, shredder paper cover 1820, i.e. moveable throat blade 1840, is designed to be pushed away from the front cover of upper shredder cover 1800, i.e. fixed throat blade 1840, such that moveable shredder inlet throat 1825 opens to a wider gap width. When operated to open throat 1825, cam 1880 can be moved clear of power switch 1810 actuation plunger 1875. When actuation plunger 1875 is no longer in contact with cam 1880, switch 1810 is positioned to de-energize the shredder motor, powered blades and operational electronics, for the user safety. In general, for a shredder with a rating corresponding to about 3 mm gap width for moveable shredder inlet throat 1825, moveable throat blade 1840 can be made to move an additional 4 mm for a 7 mm total throat gap width. Of course, nominal moveable shredder inlet throat gap width of 3 mm, moveable shredder inlet throat 1825 expansion width of 4 mm and total moveable shredder inlet throat gap width of 7 mm are examples only. Indeed, shredders may be rated for a predefined nominal throat gap width, a predefined throat expansion width, and a predefined total throat gap width, according to the rating of shreddable material for a given model of shredder. With the wider moveable throat gap, the user may clear the throat jam readily, and quickly return the shredder to service by sliding shredder paper cover 1820 back to the NORMAL/ON (standby) position.

Figure 19A:
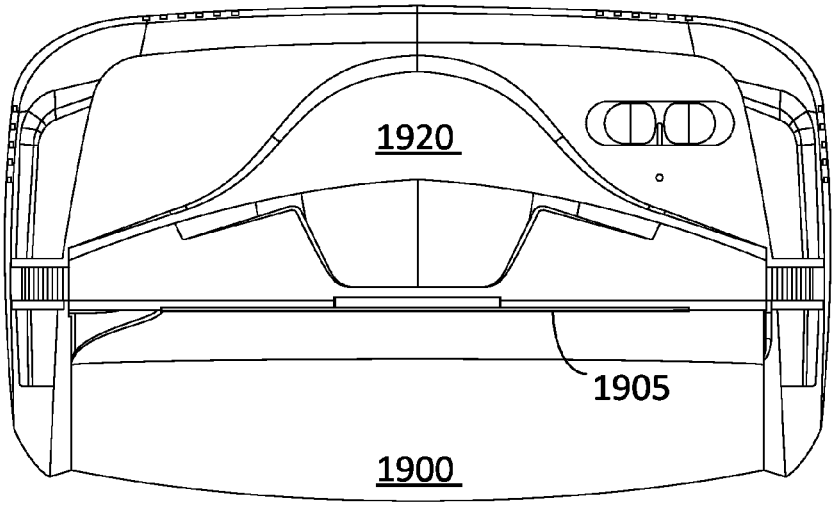
FIG. 19A is a top view illustration of an assembled upper shredder cover in nominal gap position.
Figure 19B:
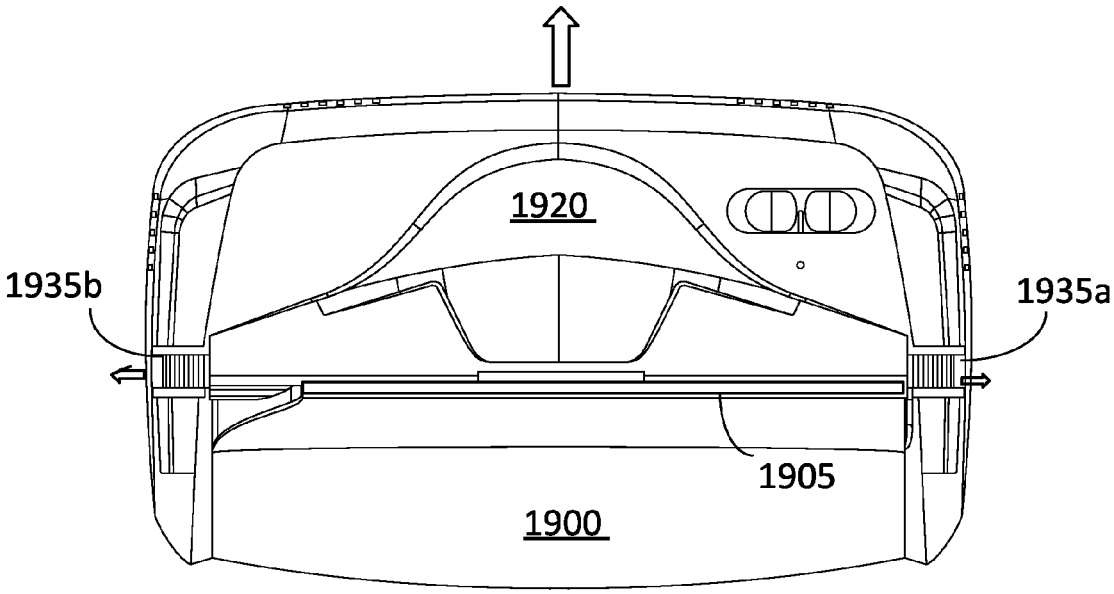
FIG. 19B is a top view illustration of an assembled upper shredder cover in wide gap position.

FIG. 19A illustrates a top view of the upper shredder cover 1900 in communication with shredder paper cover 1920, in the NORMAL/ON (standby) position, which can be like the side-view embodiments in upper shredder cover 1700 and shredder paper cover 1720, or like upper shredder cover 1800 and shredder paper cover 1820, in FIGS. 17A and 18A, respectively. FIG. 19B illustrates a top view of the upper shredder cover 1900 in communication with shredder paper cover 1920, in the JAM CLEAR/OFF position, which can be like the side-view embodiments in upper shredder cover 1700 and shredder paper cover 1720, or like upper shredder cover 1800 and shredder paper cover 1820, in FIGS. 17B and 18B, respectively.

In FIG. 19A, fixed upper shredder cover 1900 is shown to be in moveable connection with moveable shredder paper cover 1920. A normal inlet 1905 for shredder throat 1925 appears from the top as a narrow slit. However, because inlet 1905 can be laterally oriented, relative to the top view, an opening of inlet 1905 can be approximately 3 mm. wide, in the NORMAL/ON (standby) position. Again, widths depend upon the number or sheets or amount of shreddable material that the shredder is designed to comminute. In FIG. 19B, in the JAM CLEAR/OFF position, moveable shredder paper cover 1920 is shown to be moved backward, away from fixed upper shredder cover 1900, in the direction of the arrow, causing inlet 1905 to be opened, by about 4 mm additionally, to an opening of about 7 mm total. Release buttons 1935*a*, 1935*b* can be depressed and pushed to the side, in the direction of the arrows, to permit moveable shredder paper cover 1920 to be released and pushed back to the JAM CLEAR/OFF position.

Figure 20:
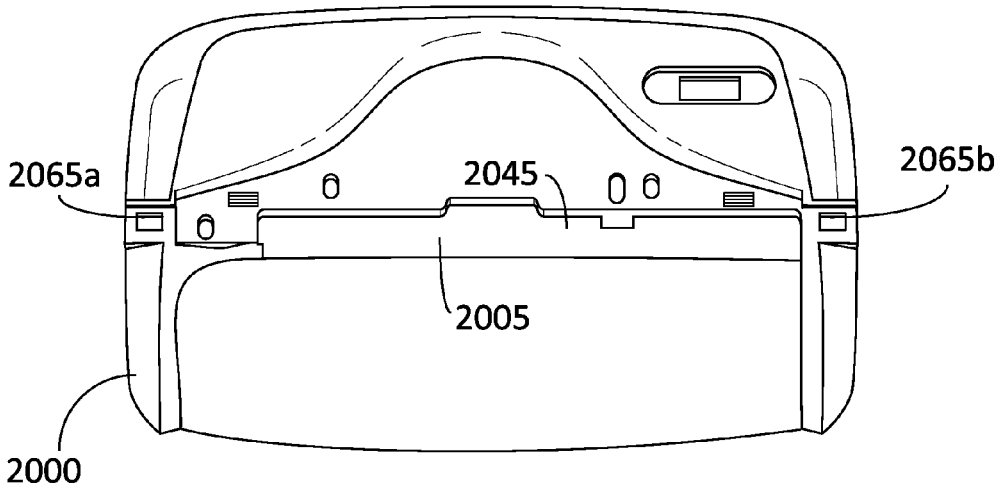
FIG. 20 is a top view illustration of a unassembled upper shredder cover.
Figure 21:
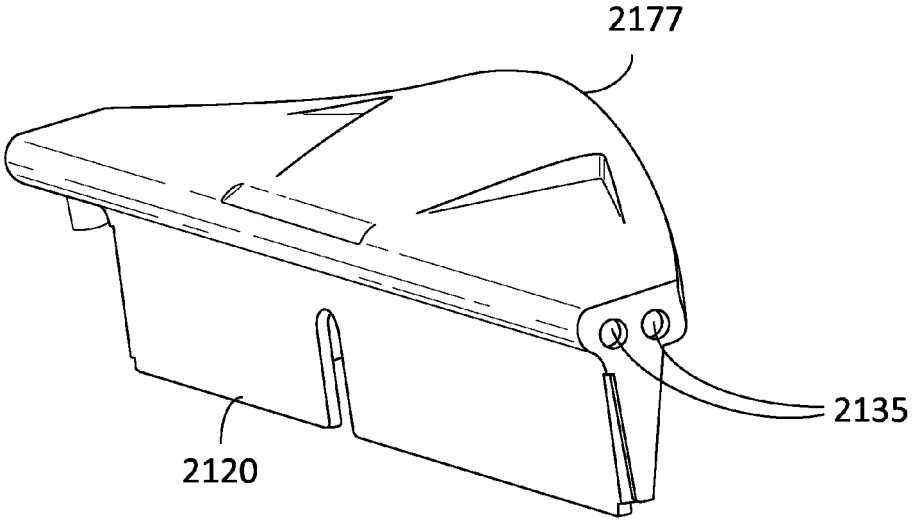
FIG. 21 is a perspective view illustration of a moveable shredder paper cover.

FIG. 20 illustrates a top view of a fixed upper shredder cover 2000, without attachments or switches. Fixed upper shredder cover 2000 can be like fixed upper shredder cover 1700, 1800, or 1900. Slot 2045 includes at least a portion of inlet 2005. Structural openings 2065*a, b* form the foundation for release buttons such as release buttons 1935*a, b* in FIG. 19. FIG. 21 is an illustration of moveable shredder paper cover 2120, which can communicate with fixed upper shredder cover 2000 of FIG. 20, by being inserted, for example, into slot 2045. From this view, moveable shredder paper cover 2120 can be seen to have a slightly arced portion 2177, which can serve as a handle to move moveable shredder paper cover 2120 when shifting between a NORMAL/ON position and a JAM CLEAR/OFF position and back. Two circular depressions 2135 can be seen in either side of the broadest part of the moveable shredder paper cover 2120, which will accommodate the cover release buttons (seen as buttons 1935*a, b* in FIG. 19).

Figure 22:
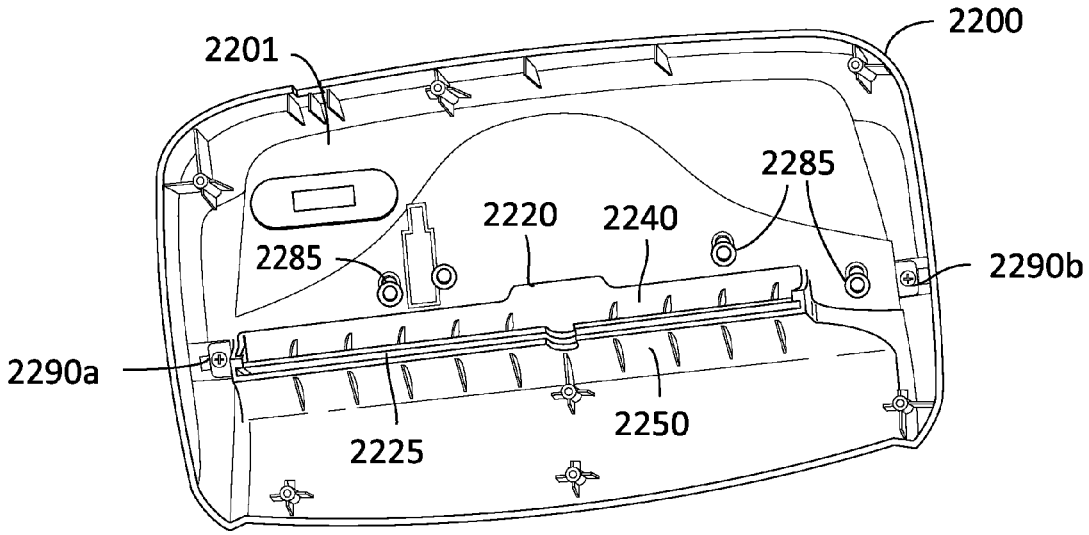
FIG. 22 is a bottom view illustration of an assembled fixed upper shredder cover, including a moveable paper shredder cover.

FIG. 22 illustrates the reverse side 2201 of fixed upper shredder 2200 such as fixed upper shredder cover 2000, having inserted therein a moveable paper shredder cover 2220, such as moveable shredder paper cover 2120. A portion of moveable inlet throat 2225 is shown as having moveable throat blade 2240 and fixed throat blade 2250. Slotted cap screws 2285 can hold moveable paper shredder cover 2220 to fixed upper shredder cover 2200 while allowing for sliding movement to open or to close the moveable paper shredder cover 2220. In FIG. 22, slotted cap screws 2285 are shown in the NORMAL/ON position of the moveable paper shredder cover 2220. Cover latch elements 2290*a, b* with securing screws can be seen to correspond to either end of moveable paper shredder cover 2220.

Figure 23:
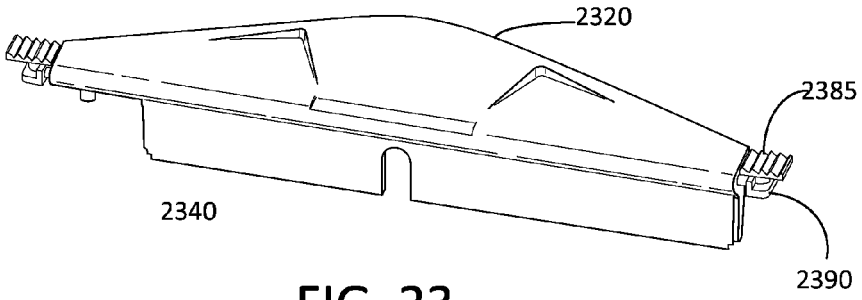
FIG. 23 is a perspective view illustration of a moveable paper shredder cover.

In FIG. 23, moveable paper shredder cover 2320 is shown having moveable shredder inlet throat 2340 and grip release assembly 2385. Grip release assembly 2385 can be elements of release buttons 1935*a, b* when installed on a fixed upper shredder such as fixed upper shredder 2200. Elements of release buttons can include grip release assembly 2385 and latching posts 2390. By pushing the release buttons outward, grip release assembly 2385 disconnects from moveable paper shredder cover 2320, and latching posts 2390 retreat from depressions (seen as circular depressions 2135 in FIG. 21) in moveable paper shredder cover 2320, the allowing it to be moved backward (relative to the shredder front) such that the shredder power turns off.

Figure 24:
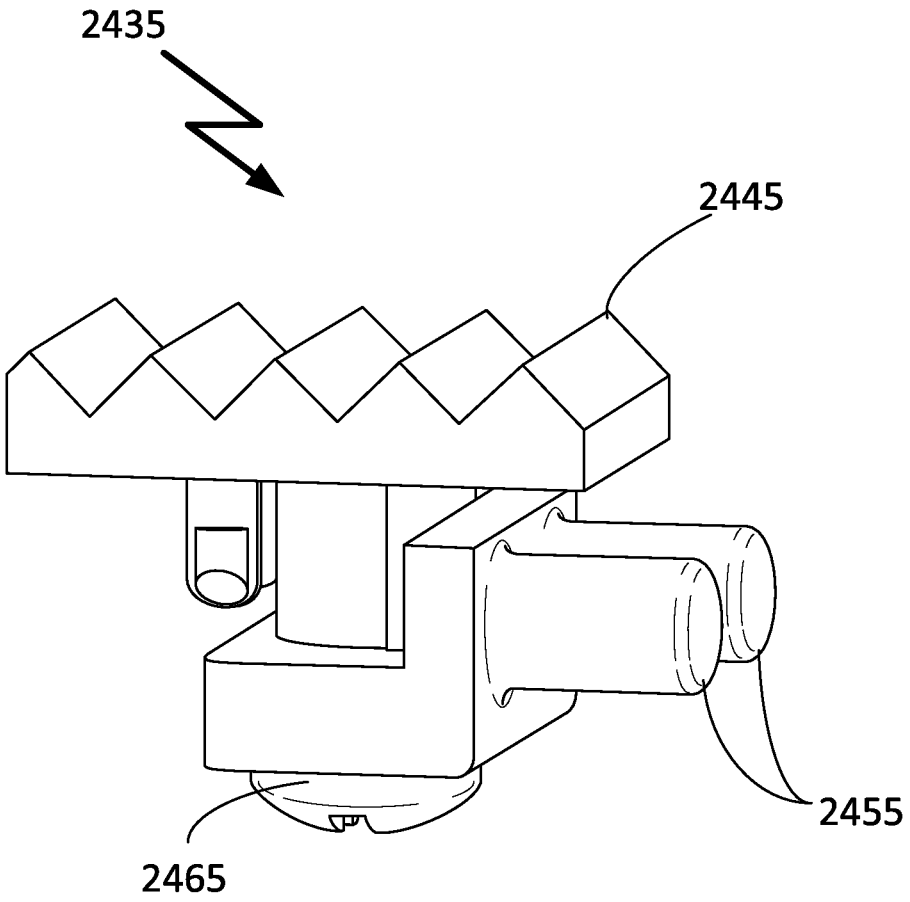
FIG. 24 is a perspective view illustration of a moveable paper shredder cover release assembly.

FIG. 24 illustrates release assembly 2435, which is similar to release button 1935*a, b* in FIG. 19, shown without the structural openings provided by a fixed upper cover such as structural openings 2065*a, b* in fixed upper cover 2000 from FIG. 20. Release assembly 2435 can be formed from top grips 2445 coupled to cover latching posts 2455 coupled to top grip 2445 by way of securing screws 2465. Relative to fixed upper cover such as cover 2000 in FIG. 20, top grip 2445 can be disposed atop a structural opening such as one of structural openings 2065*a,b* in FIG. 20, with release assembly 2435 disposed beneath one of structural openings 2065*a,b*. In the NORMAL/ON position, latching posts 2455 can be nested inside of the corresponding circular depressions, such as circular depressions 2135 in moveable shredder paper cover 2120. This restrains the shredder paper cover from moving. When a user laterally pulls release assembly 2435, pressure from top grip 2445 can be transmitted to latching posts 2455. Latching posts 2455 can be removed from two circular depressions in the shredder paper cover, such as two circular depressions 2135 in moveable shredder paper cover 2120, allowing motion of the moveable shredder paper cover and corresponding moveable throat blade, for example, to the JAM CLEAR/OFF position.

Figure 25:
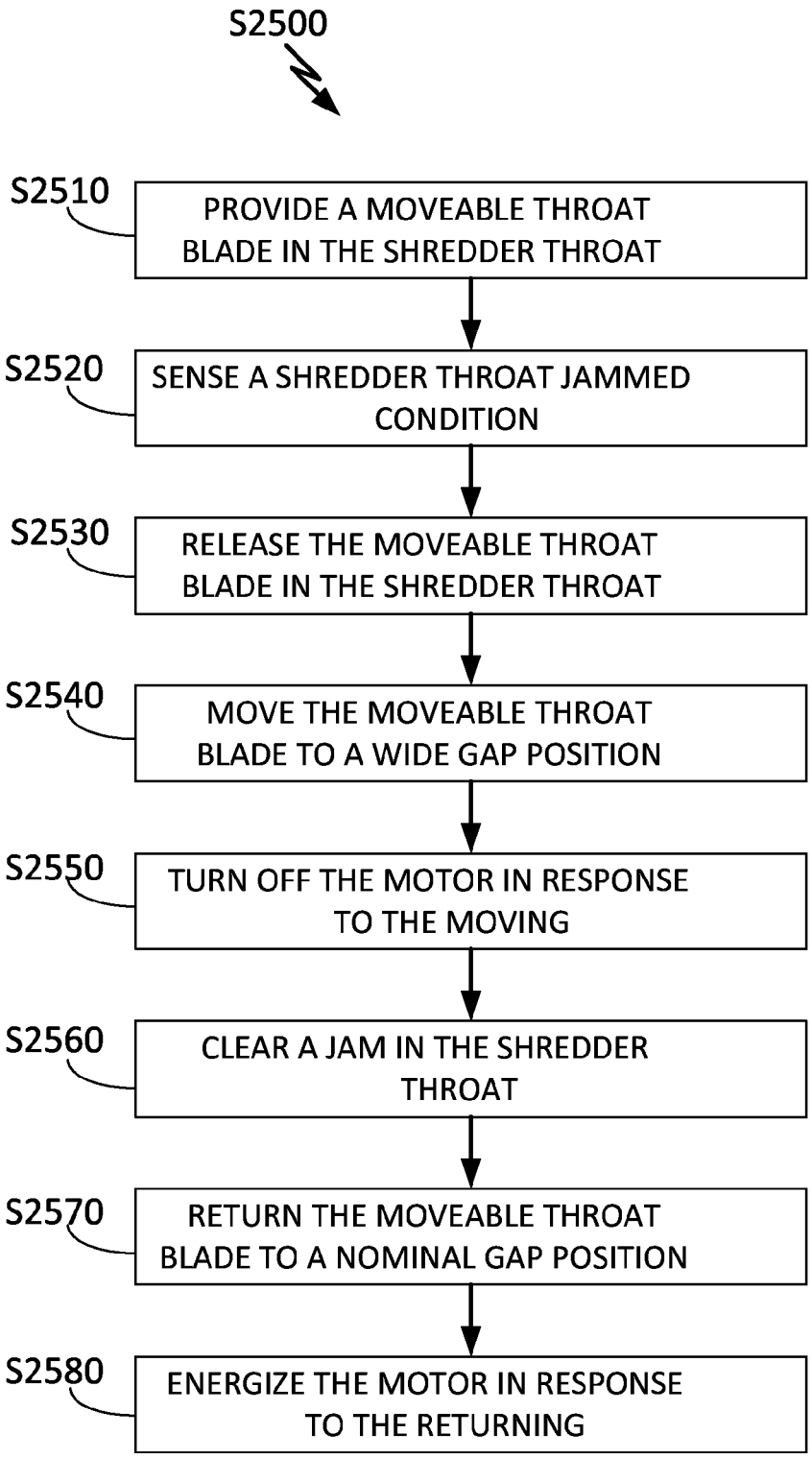
FIG. 25 is a block diagram illustration of a method according to the teachings herein.

In FIG. 25, a method 2500 for recovering from a shredder jam in a paper shredder having a motor coupled to shredder blades also is recited including providing (S2510) a moveable throat blade in the shredder throat; sensing (S2520) a shredder throat jammed condition; releasing (S2530) the moveable throat blade in the shredder throat; moving (S2540) the moveable throat blade to a wide gap position; turning (S2550) off the motor in response to the moving; clearing (S2560) a jam in the shredder throat; returning (S2570) the moveable throat blade to a nominal gap position; and energizing (S2580) the motor in response to the returning.

Sensing the moveable throat blade in the wide gap position may include providing an advance switch activated by the moveable throat blade in the wide gap position, the advance switch configured to advance the shredder blades when the advance switch is activated. In some embodiments, sensing a shredder throat jammed condition includes sensing a predetermined motor torque value. In other embodiments, sensing a shredder throat jammed condition includes sensing a predetermined force value against the moveable throat blade. In yet other embodiments, sensing the moveable throat blade in the wide gap position includes providing a switch activated by the moveable throat blade in the wide gap position, the switch configured to advance the shredder blades when the switch is activated. In still other embodiments, sensing the moveable throat blade in the wide gap position includes providing a manually-activated switch configured to advance the shredder blades when the switch is activated. In yet some other embodiments, sensing the shredder throat jammed condition comprises providing a perceptible indication indicative of the shredder throat jammed condition.

In some of the above embodiments, the shredder motor can move forward to comminute the jammed wad of shredding material. However, the motor also may momentarily move in reverse in order to dislodge the jammed wad, and then move forward to digest the jammed wad into shreddant. Although 4 mm has been given as a nominal shredder inlet gap, of course, the nominal gap size may vary with the nominal amount of material that a shredder may comminute. Similarly, although 7 mm has been provided as a maximum, the maximum gap size may similarly vary as with the nominal shredder inlet gap. "Nominal" (or "normal") and "Wide" gap sizes may vary according to shredder model, capacity, and rating. Also, a shredder may be provided with a flexible, moveable shredder throat to facilitate manual removal when there is a jam.

Although the present embodiments have been described by way of example with references to the current drawings, it is to be noted herein that various changes and modifications will be apparent to those skilled in the art. Therefore, unless such changes and modifications depart from the scope of the present invention, they should be construed as being included therein.

The invention claimed is:

1. A paper shredder having an electric motor coupled to shredder blades, comprising:

a shredder throat having a fixed throat blade and a moveable throat blade disposed opposite the fixed throat blade, wherein the moveable throat blade provides a wide gap shredder throat and a normal gap shredder throat with respect to the fixed throat blade;

a cam coupled to the moveable throat blade; and a power control switch engageable with the cam and having an engaged mode and a disengaged mode, wherein the engaged mode corresponds to a normal gap shredder throat, wherein the disengaged mode corresponds to a wide gap shredder throat, wherein in the engaged mode the cam positions the power control switch to provide electrical power to the electric motor, and wherein in the disengaged mode the cam positions the power control switch to block electrical power to the electric motor.

2. The paper shredder of claim 1, wherein the moveable throat blade is moved manually.

3. The paper shredder of claim 2, wherein an anti-jam switch is activated by contact with the moveable throat blade.

4. A paper shredder having an electric motor coupled to shredder blades, comprising:

a shredder throat having a fixed throat blade and a moveable throat blade disposed opposite the fixed throat blade, wherein the moveable throat blade provides a wide gap shredder throat and a normal gap shredder throat with respect to the fixed throat blade;

a cam attached to the moveable throat blade; and a power control switch engageable with the cam and having an engaged mode and a disengaged mode, wherein the engaged mode corresponds to a wide gap shredder throat, wherein the disengaged mode corresponds to a normal gap shredder throat, wherein in the disengaged mode the cam positions the power control switch to provide electrical power to the electric motor, and wherein in the engaged mode the cam positions the power control switch to block electrical power to the electric motor.

5. The paper shredder of claim 4, wherein the moveable throat blade is moved manually.

6. The paper shredder of claim 5, wherein an anti-jam switch is activated by contact with the moveable throat blade.

7. A method for recovering from a shredder jam in a paper shredder having a motor coupled to shredder blades, comprising:

providing a moveable throat blade in the shredder throat;

sensing a shredder throat jammed condition;

releasing the moveable throat blade in the shredder throat;

moving the moveable throat blade to a wide gap position;

turning off the motor in response to the moving;

clearing a jam in the shredder throat;

returning the moveable throat blade to a nominal gap position; and energizing the motor in response to the returning.

8. The method of claim 7, wherein sensing the moveable throat blade in the wide gap position comprises:

providing a switch activated by the moveable throat blade in the wide gap position, the switch configured to advance the shredder blades when the switch is activated.

9. The method of claim 8, further comprising sensing the moveable throat blade in the wide gap position; and providing a manually-activated switch configured to advance the shredder blades when the manually-activated switch is activated.

10. The method of claim 7, wherein sensing a shredder throat jammed condition comprises sensing a predetermined motor torque value.

11. The method of claim 7, wherein sensing a shredder throat jammed condition comprises sensing a predetermined force value against the moveable throat blade.

12. The method of claim 7, wherein sensing the shredder throat jammed condition comprises providing a perceptible indication indicative of the shredder throat jammed condition.

* * * * *